US008113294B2

(12) United States Patent
Arai et al.

(10) Patent No.: US 8,113,294 B2
(45) Date of Patent: Feb. 14, 2012

(54) BEACH CLEANER

(75) Inventors: Shokichi Arai, Saitama (JP); Hidekazu Sakai, Saitama (JP); Tadashi Oshima, Saitama (JP); Tetsuro Hosoda, Saitama (JP); Akito Hiramatsu, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 956 days.

(21) Appl. No.: 11/730,545

(22) Filed: Apr. 2, 2007

(65) Prior Publication Data

US 2007/0227751 A1 Oct. 4, 2007

(30) Foreign Application Priority Data

Apr. 3, 2006 (JP) ..... 2006-101616

(51) Int. Cl.
*A01D 15/00* (2006.01)

(52) U.S. Cl. ..... 171/111; 171/63

(58) Field of Classification Search ..... 171/1, 63, 171/111

See application file for complete search history.

(56) References Cited

U.S. PATENT DOCUMENTS

| | | | | | |
|---|---|---|---|---|---|
| 211,069 | A | * | 12/1878 | Van Order | 171/63 |
| 267,907 | A | * | 11/1882 | Leininger | 209/52 |
| 745,203 | A | * | 11/1903 | Latta | 172/611 |
| 970,921 | A | * | 9/1910 | Hecht | 172/621 |
| 1,091,831 | A | * | 3/1914 | Gibbons | 172/711 |
| 1,922,219 | A | * | 8/1933 | Schumann | 172/624 |
| 1,997,248 | A | * | 4/1935 | Densberger | 172/688 |
| 2,019,369 | A | | 10/1935 | Teel | |
| 2,187,262 | A | * | 1/1940 | Brown | 172/237 |
| 2,700,856 | A | * | 2/1955 | Summach et al. | 172/532 |
| 2,706,877 | A | * | 4/1955 | Caldwell | 171/63 |
| 2,719,393 | A | | 10/1955 | Bowersox | |
| 3,003,785 | A | * | 10/1961 | Straszheim et al. | 280/759 |
| 3,255,831 | A | * | 6/1966 | Kirkpatrick, Jr. | 172/611 |
| 3,705,630 | A | * | 12/1972 | Vissers | 172/713 |
| 3,809,166 | A | * | 5/1974 | van der Lely et al. | 172/49.5 |
| 3,976,145 | A | * | 8/1976 | Blair | 172/615 |
| 4,589,497 | A | * | 5/1986 | Kovar | 172/707 |
| 4,664,404 | A | * | 5/1987 | Schultz | 280/461.1 |
| 4,790,389 | A | * | 12/1988 | Adee et al. | 172/776 |
| 4,896,730 | A | * | 1/1990 | Jarrett et al. | 172/40 |
| 5,462,309 | A | * | 10/1995 | Jeffers et al. | 280/759 |
| 6,216,796 | B1 | * | 4/2001 | Frank et al. | 172/684.5 |
| 6,540,030 | B2 | * | 4/2003 | Ohzeki et al. | 171/1 |
| 6,568,482 | B2 | * | 5/2003 | Ohzeki et al. | 171/111 |
| 6,634,434 | B2 | * | 10/2003 | Ohzeki et al. | 171/63 |
| 6,763,949 | B2 | * | 7/2004 | Ohzeki et al. | 209/409 |
| 2002/0040791 | A1 | | 4/2002 | Ohzeki et al. | |

FOREIGN PATENT DOCUMENTS

| | | |
|---|---|---|
| GB | 288808 | 4/1928 |
| JP | 4-119819 U | 10/1992 |
| JP | 2002-115226 A | 4/2002 |
| JP | 3623435 B2 | 12/2004 |

* cited by examiner

*Primary Examiner* — Thomas Will
*Assistant Examiner* — Joel F. Mitchell
(74) *Attorney, Agent, or Firm* — Birch, Stewart, Kolasch & Birch, LLP

(57) ABSTRACT

A beach cleaner having a grate-like frame is formed with multiple longitudinal members. Each of the longitudinal members is provided with a plurality of sand pins projecting downward therefrom, and the frame is provided at its front end with the tow portion. The beach cleaner can be towed by a towing vehicle to generate on a sand area, while the sand pins scrape and collect waste scattered on the sand. The sand pins are detachably attached to the longitudinal members. The beach cleaner also includes a weight mount member, enabling the amount of burying the sand pins in a sand area to be optimized to enhance waste collection performance.

17 Claims, 26 Drawing Sheets

BEACH CLEANER

CROSS-REFERENCE TO RELATED APPLICATION

The present application claims priority under 35 U.S.C. §119 to Japanese Patent Application No. 2006-101616, filed Apr. 3, 2006, the entire contents of which are hereby incorporated by reference.

BACKGROUND OF THE INVENTION

1. Field of the Invention

The present invention relates to a beach cleaner which collects various waste scattered on a sand area such as a bathing beach.

2. Description of Background Art

Examples of such an existing beach cleaner described above include a beach cleaner as below. The beach cleaner includes a plurality of longitudinal members extending in the traveling direction are spaced at desired intervals apart from each other to form a floor grate-like frame. The longitudinal members are provided with a plurality of sand pins projecting downward. While the sand pins are buried in a sand area, the beach cleaner is towed by a towing vehicle to run on the sand area, thereby enabling collecting relatively large waste. (See Japanese Patent No. 3623435.)

Incidentally, the beach cleaner described above may result in an excessive increase in traveling resistance because the sand pins are buried too far into a soft sand area. On the other hand, in a hard sand area, the cleaner may be susceptible to almost floating because the sand pins are not sufficiently buried into the sand. As a result, the waste collection performance of the beach cleaner may be adversely affected.

SUMMARY AND OBJECTS OF THE INVENTION

Accordingly, it is an object of the present invention to enhance the waste collection performance of a beach cleaner provided with a plurality of sand pins projecting downward from a floor grate-like frame by optimizing an amount of burying the sand pins in a sand area.

According to a first aspect of the present invention, a beach cleaner (e.g. the first beach cleaner 20, 120, 220 of the embodiment) includes a plurality of longitudinal members (the longitudinal members 21 of the embodiment) extending in a traveling direction are spaced widthwise apart from each other to form a floor grate-like frame (e.g. the frame 22 of the embodiment). The longitudinal members are provided with a plurality of sand pins (e.g. the san pins 23 of the embodiment) projecting downward therefrom, and the frame is provided at a front end thereof with a tow portion (e.g. the tow portion 37 of the embodiment). The beach cleaner is pulled by a towing vehicle (e.g. the tow vehicle 1 of the embodiment) to run on a sand area, while the sand pins scrape and collect waste scattered on the sand. The sand pins are detachably attached to the longitudinal members.

According to a second aspect of the present invention, the frame is provided with a weight mount portion (e.g. the weight mount portion 31 of the embodiment).

According to a third aspect of the present invention, a waste collecting portion (e.g. the waste collecting portion 21*a* of the embodiment) is provided between the sand pins aligned in the back and forth direction in the frame.

According to a fourth aspect of the present invention, a joint portion (e.g. the joint portion 22*a* of the embodiment) is provided between the sand pins aligned in the back and forth direction in the frame.

EFFECTS OF THE INVENTION

According to the first aspect of the present invention, the number of the sand pins can be increased and reduced. The number of the sand pins is reduced when the sand area has large resistance and the number of the sand pins is increased when the sand area has small resistance. Thus, the amount of burying the sand pins in the sand area is optimized to enhance waste collection performance.

According to the second aspect of the present invention, the amount of burying the sand pins in the sand area can be also adjustable by the heft of the weight, thereby further enhancing the waste collection performance.

According to the third aspect of the present invention, floating of the frame and the sand pins because of riding on the waste collected by the sand pins is prevented, whereby the waste collection performance can be satisfactorily maintained.

According to the fourth aspect of the present invention, floating of the frame and the sand pins because of riding on the waste collected by the sand pins is prevented, whereby the waste collection performance can be satisfactorily maintained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
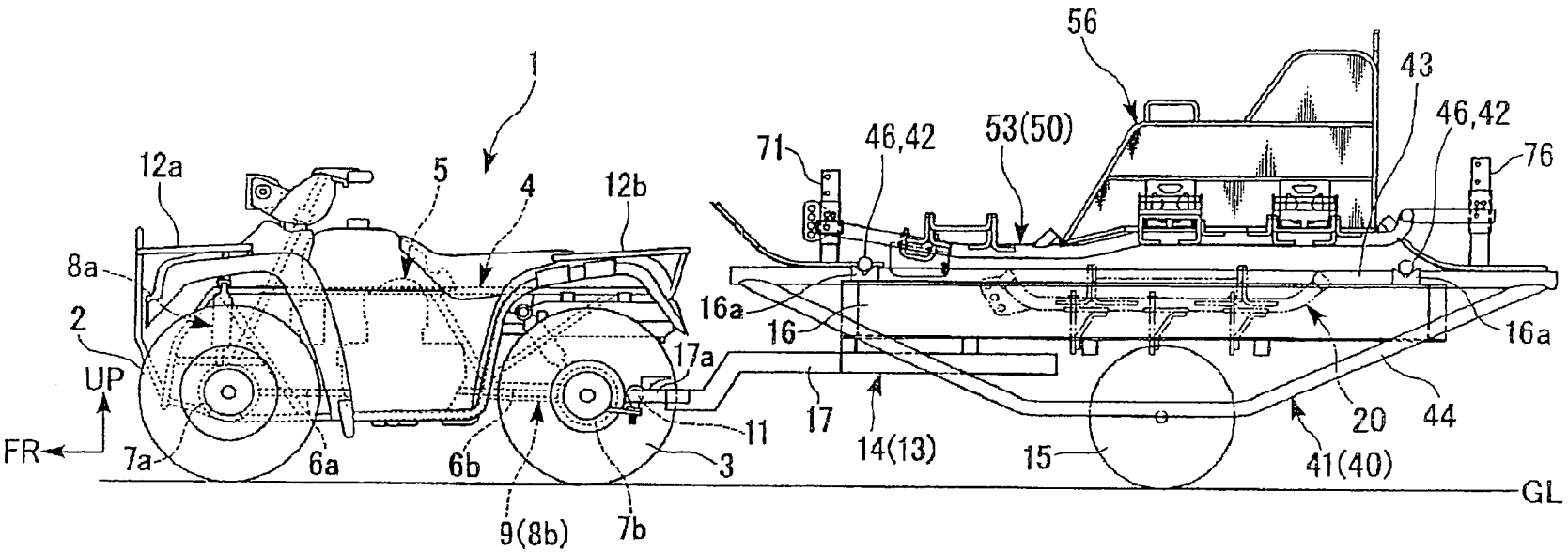
FIG. 1 illustrates a state where beach cleaners and the like according to an embodiment of the invention loaded on a trailer are carried.

A vehicle 1 depicted in FIG. 1 is configured as a so-called ATV (All Terrain Vehicle). The vehicle 1 includes left and right front wheels 2 and rear wheels 3 disposed at the front portion and rear portion, respectively, of a vehicle body formed small in size and light in weight. The wheels are low pressure balloon tires with a relatively large diameter. Thus, the vehicle 1 ensures a large minimum ground height, thereby enhancing traveling performance on, particularly, the irregular terrain. A body frame 4 of the vehicle body 1 is formed at the widthwise central portion to have a box structure long in the back and forth direction. An engine 5 as a prime mover for the vehicle 1 is mounted on the almost central portion of the body frame 4.

The engine 5 is a water-cooled single cylinder engine for example. The rotational power of a crankshaft is output to front and rear propeller shafts 6*a* and 6*b* via a gear-meshing type transmission. The rotational power output to the front and rear propeller shafts 6*a* and 6*b* are output to left and right front and rear wheels 2 and 3 via front and rear reduction gears 7*a* and 7*b*, respectively.

The vehicle 1 is a so-called semi-automatic vehicle which is able to electrically change the gear ratio of the transmission. The gear ratio can be changed through, for example, a centrifugal clutch, by operating only a change button or the like without operating the clutch. Such a vehicle 1 is suitable for running with a large running load or at constant speed as compared with a vehicle equipped with a belt type transmission.

The left and right front wheels 2 are suspended by the front portion of the body frame 4 through front independent suspensions 8*a*. The left and right rear wheels 3 are suspended by the rear portion of the body frame 4 through e.g. swing arm type rear suspensions 8*b*. Trailer hitches 11 for towing a trailer are provided at the rear ends of swing arms 9 of the rear suspensions 8*b*. In the figure, reference numeral 12*a* denotes a front carrier supported by the front portion of the body frame 4 and 12*b* denotes a rear carrier supported by the rear portion of the body frame 4.

The vehicle 1 can tow a trailer 13 which carries a first and a second beach cleaner 20, 50 and a waste recovery station 40.

The trailer 13 includes a pair of left and right wheels 15, a carrier 16 and a tow-arm 17. The wheels 15 are provided on both sides of the lower portion of a body frame 14 of the trailer 13 for instance. The carrier 16 is in a shallow box shape opening upward and is provided on the body frame 14. The tow-arm 17 extends from the lower side of the front portion of the body frame 14 toward the forward. A hitch coupler 17*a* associated with the trailer hitch 11 is provided at the front end of the tow-arm 17.

Receiving members 16*a* adapted to support connecting pipes 46, described later, of a waste recovery station 40 are provided at upper edge portions, of a carrier 16, located on front and rear, left and right sides thereof. The receiving member 16*a* is formed with a V-shaped recess opening upward. The connecting pipe 46 is supportably received in the recess with the wasted recovery station 40 in the loaded state turned upside down. A second beach cleaner 50 is loaded on the waste recovery station 40 in the loaded state, while being engaged with, e.g. grounded members 43 described later so as to be restricted in movement. In addition, a first beach cleaner 20 is loaded on the waste recovery station 40 in the loaded state, while being received, e.g. in the carrier 16.

Figure 2:
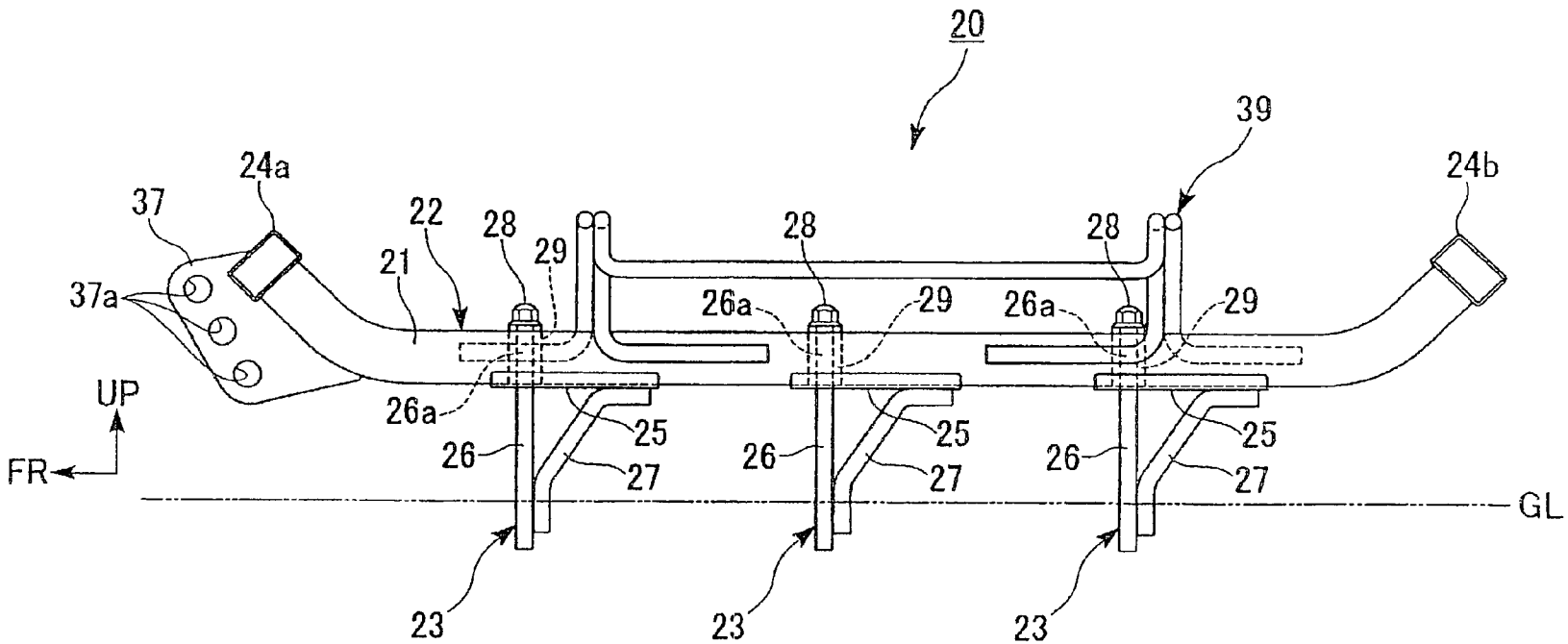
FIG. 2 is a side view of a first beach cleaner of the embodiment.

FIG. 1 illustrates a state in which the beach cleaners 20, 50 and the waste recovery station 40 are loaded on the trailer 13. FIG. 2 and the subsequent figures illustrate a state in which the beach cleaners 20, 50 and the waste recovery station 40 are used on a sand area, unless otherwise specified. In the figures, line GL denotes the ground (the upper surface of the sand area) and line CL denotes the respective widthwise centers of the vehicle 1, the beach cleaners 20, 50 towed by the vehicle 1 and the waste recovery station 40 through which the beach cleaners 20, 50 pass. (The vehicle 1, the beach cleaners 20, 50 and the waste recovery station 40 are hereinafter called the vehicle and the like.) Arrow FR denotes the forward in the running direction (the back and forth direction) of the vehicle or the like. Arrow UP denotes the upside in the upward and downward direction of the vehicle and the like. Arrow LH denotes the left in the leftward and rightward direction in the vehicle and the like.

While running on a sand area (a sandy beach) of a sea shore, the beach cleaners 20, 50 collect various waste scattered on the sand area. The waste collected by the beach cleaners 20, 50 is collectively recovered by the waste recovery station 40 installed on the desired site on the sand area. The beach cleaners 20, 50 and the waste recovery station 40 are appropriately assembled by a plurality of kinds of steel materials such as stainless steel using joining means such as welding. Incidentally, the beach cleaners 20, 50 may be towed by a tractor.

Figure 3:
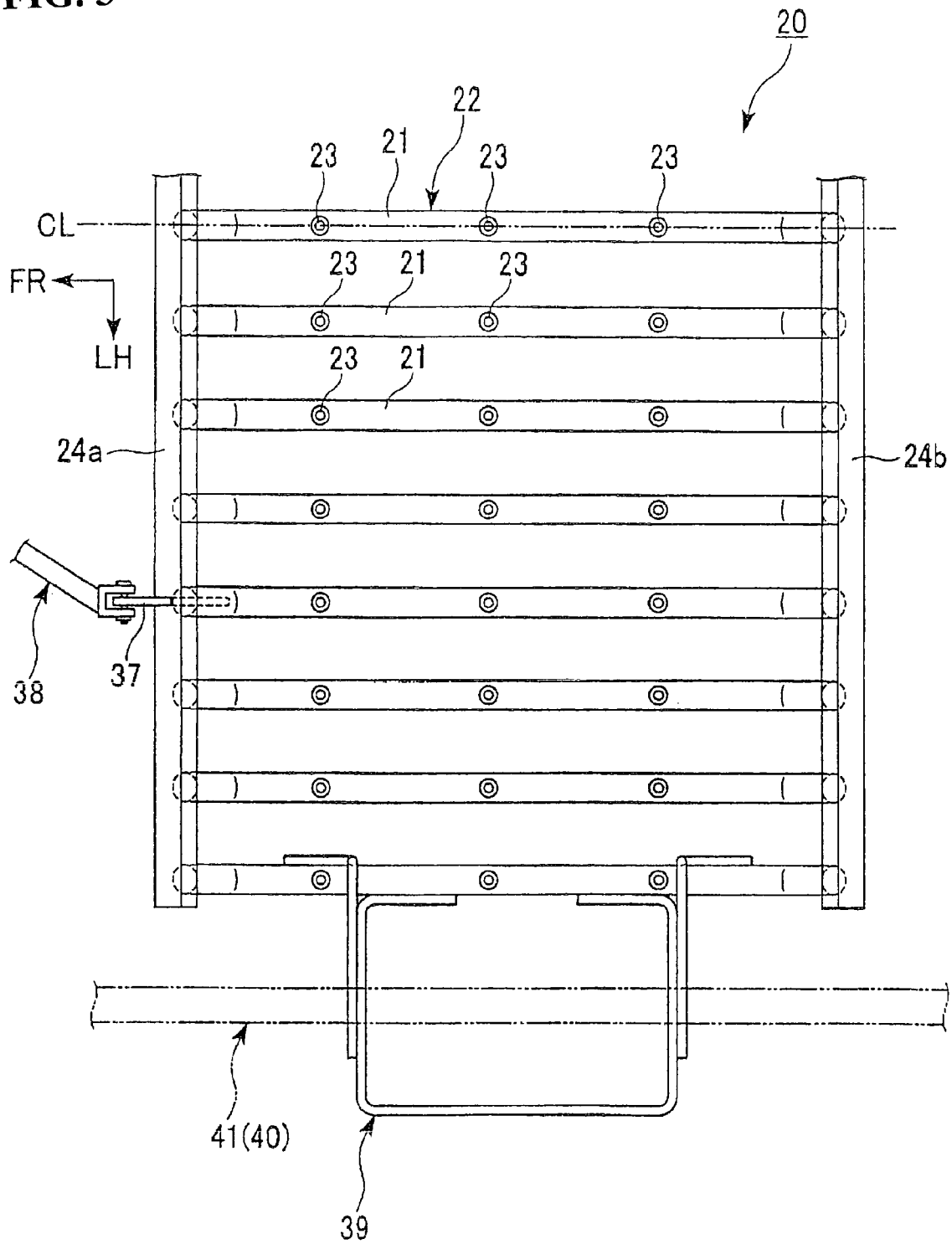
FIG. 3 is a plan view of FIG. 2.

Referring to FIGS. 2 and 3, the first beach cleaner 20 includes a plurality of (e.g. 15) longitudinal members 21 which extend in the running direction and are placed so as to be almost evenly spaced apart from each other in the widthwise direction (the leftward and rightward direction), thereby forming a floor grates-like frame 22. In addition, a plurality of sand pins 23 are detachably attached to the respective longitudinal members 21 so as to project downward. Incidentally, the first beach cleaner 20 is configured to be symmetrical.

The longitudinal member 21 is made of e.g. a circular steel tube (or rectangular steel tube). The longitudinal member 21 extends along the back and forth direction and has front and rear end portions which bend upwardly forwardly and upwardly rearward, respectively. A plurality of the longitudinal members 21 are juxtaposed to each other right and left so as to be superposed as viewed from the side. The longitudinal member 21 is connected at its front end to a front lateral member 24*a* so as to be abutted against it from obliquely and downward-rearward. The front lateral member 24*a* is made of e.g. a rectangular steel tube and extends in the leftward and rightward direction. In addition, the longitudinal member 21 is connected at its rear end to a rear lateral member 24*b* so as to be abutted against it from obliquely and downward-forwardly. The rear lateral member 24*b* is made of e.g. a rectangular steel tube and extends in the leftward and rightward direction.

The frame 22 composed of the longitudinal members 21 and the lateral members 24*a*, 24*b* is formed in a horizontally long rectangle as viewed from above. The left-right width of the frame 22 is made equal to or slightly greater than that of the vehicle 1 and smaller than that between left and right side structures 41 of the waste recovery station 40 described later.

The sand pins 23 can be attached to the front portion, intermediate portion and rear portion of each longitudinal member 21. In other words, the sand pins 23 are arranged in three rows in the back and forth direction. This makes it possible to suppress travel resistance during low-speed travel and to further suppress travel resistance by reducing the number of the sand pins 23 according to the hardness of the sand area or the like. The length of the sand pin 23 that project from the lower surface of the frame 22 is set to 100 mm at most in order to suppress an effect on the ecological system in the sand area.

While the first beach cleaner 20 as described above travels on the sand area, relatively large waste (ropes, nets, driftwood, etc.) scattered is caught or tangled with and thus raked up by the sand pins 23.

Figure 4A:
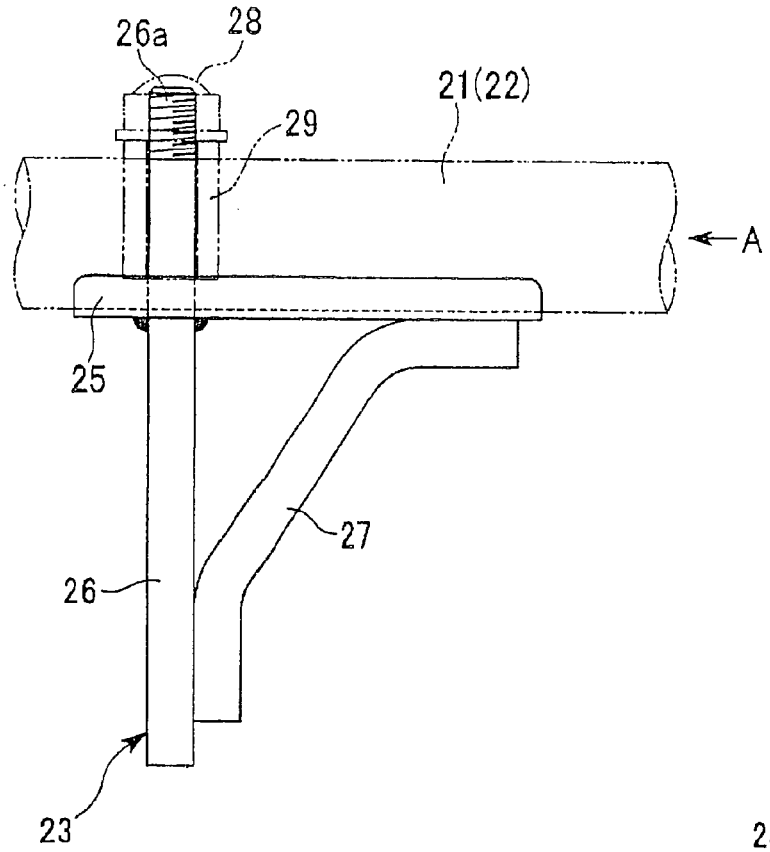
FIGS. 4(*a*) and (*b*) include explanatory views of a sand pin of the first beach cleaner, in which FIG. 4(*a*) is a side view and FIG. 4(*b*) is a view as viewed from arrow A of FIG. 4(*a*)
Figure 4B:
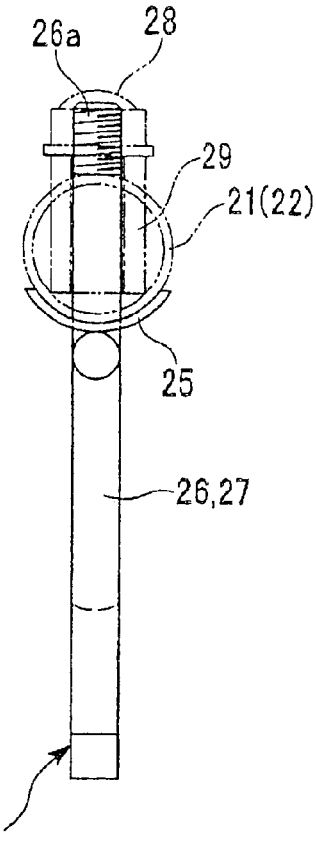

Additionally referring to FIG. 4, the sand pin 23 includes a plate-like member 25, a pin main body 26 and a support member 27. The plate-like member 25 bends to conform to the lower outer surface of the longitudinal member 21. The pin main body 26 vertically passes through the plate-like member 25. The support member 27 bridges over the lower portion of the pin main body 26 and the rear portion of the plate-like member 25. The support member 27 is formed to be in a triangle, as viewed from the side, tapered toward the downside. The pin main body 26 is formed at its upper portion with an external thread portion 26*a*. While this external thread portion 26*a* passes through the longitudinal member 21 from below and projects upward therefrom, the plate-like member 25 is abutted against the lower surface of the longitudinal member 21. In this state, a hexagon cap nut 28 is threaded and fastened onto the external thread portion 26*a*, whereby the sand pin 23 is fastened to the longitudinal member 21. A cylindrical collar 29 is fixedly inserted through a portion of the longitudinal member 21 through which the pin main body 26 passes.

Figure 5A:
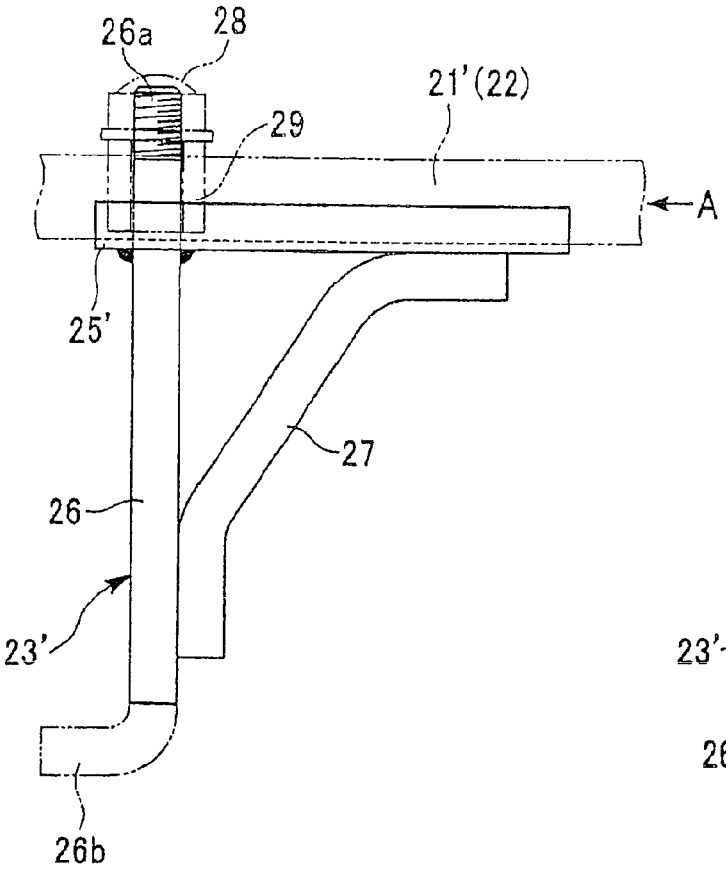
FIGS. 5(*a*) and (*b*) include explanatory views of a modified example of the sand pin, in which FIG. 5(*a*) is a side view and FIG. 5(*b*) is a view as viewed from arrow A of FIG. 5(*a*)
Figure 5B:
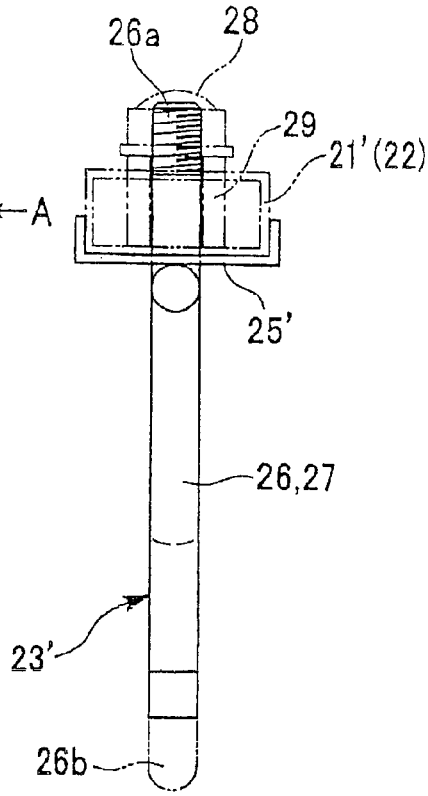

As shown in FIG. 5, if a longitudinal member 21' is made of a rectangular steel tube, a sand pin 23' designed to accommodate to the longitudinal member 21' may be used. Specifically, the sand pin 23' includes a plate-like member 25' which is U-shaped in section so as to conform to the lower outer surface of the longitudinal member 21'. In the state where the plate-like member 25' conforms to the lower portion of the longitudinal member 21, a hexagon cap nut 28 is threaded and fastened onto the external thread portion 26*a*, whereby the sand pin 23' is fastened to the longitudinal member 21'. The longitudinal member 21' has a relatively broad left-right width in section. Use of such a longitudinal member 21' enhances glide performance of the first beach cleaner 20 relative to a sand area. If the lower end of the pin main body 26 is made to bend forward to form a folding back part 26*b*, waste recovery performance can be further enhanced.

Figure 6:
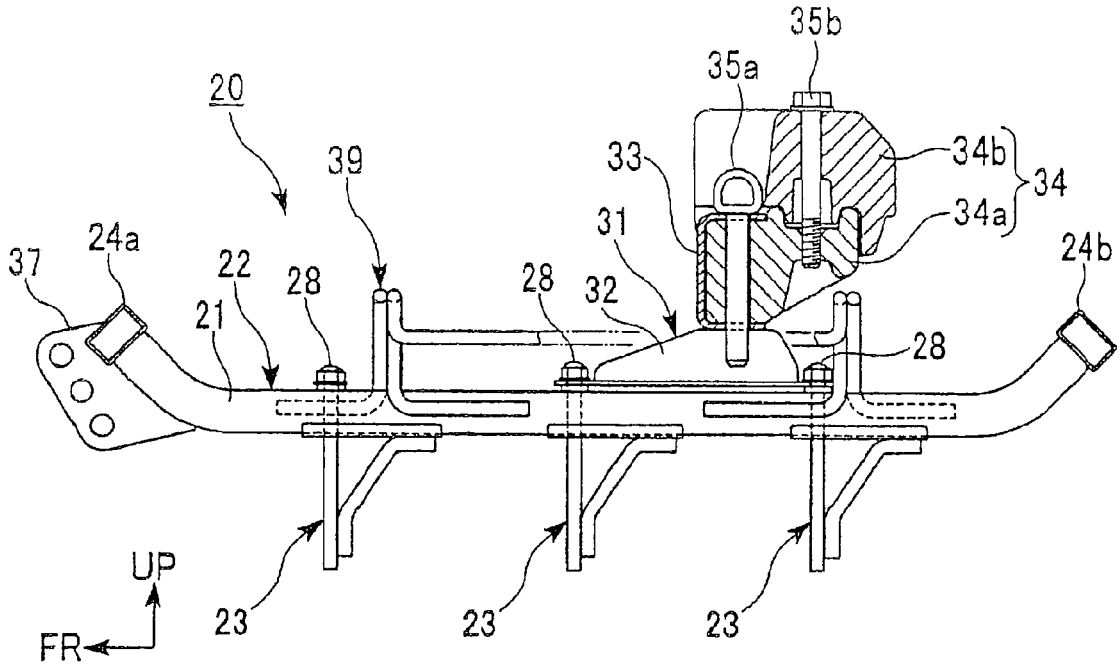
FIG. 6 is a side view illustrating a weight mount portion attached to the first beach cleaner.
Figure 7:
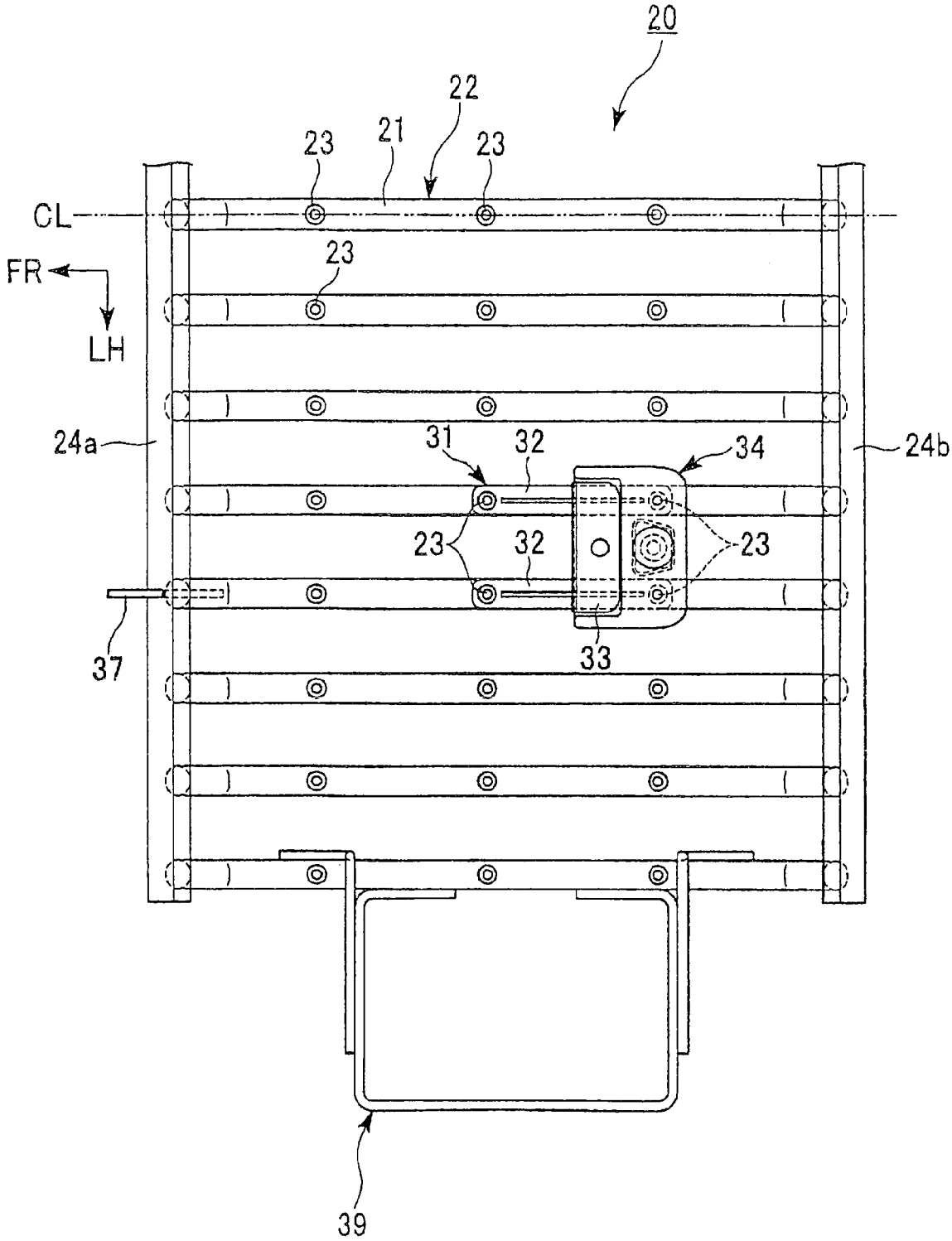
FIG. 7 is a plan view of FIG. 6.

Referring to FIGS. 6 and 7, a weight mount portion 31 adapted to adjust an amount of digging the sand pins 23 in the sand can be installed on the frame 22 of the first beach cleaner 20.

Figure 8A:
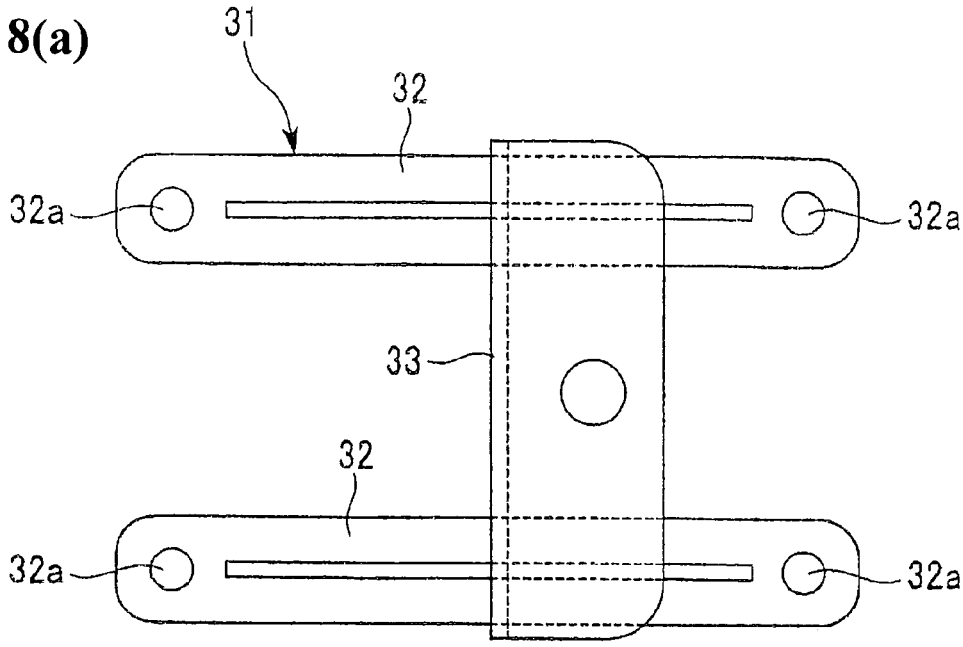
FIGS. 8(*a*) and (*b*) include explanatory views of the weight mount portion of FIG. 6, in which FIG. 8(*a*) is a plan view and FIG. 8(*b*) is a side view.
Figure 8B:
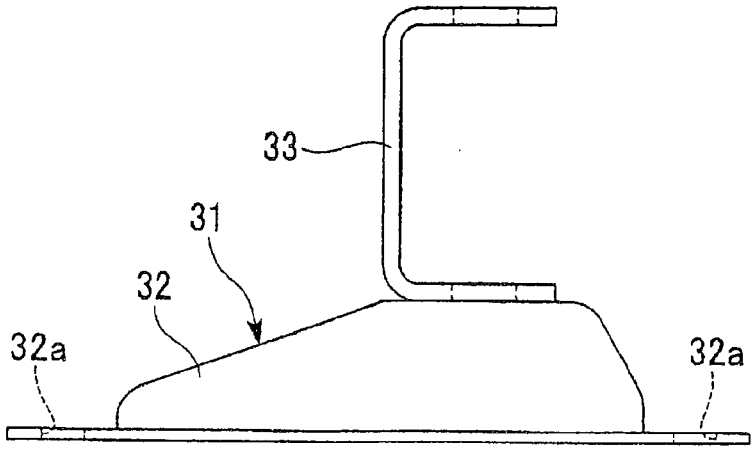

Additionally referring to FIG. 8, the weight mount portion 31 is configured by integrally connecting base parts 32 juxtaposed right and left using a support bracket 33. The base parts 32 are longitudinally long, that is, extend in the back and forth direction and are arranged to have the same left-right width as that of the adjacent longitudinal members 21 of the frame 22. Each base part 32 is formed at its front and rear edges with insertion holes 32*a* adapted to receive the external thread portions 26*a* of the sand pins 23 insertable therethrough. The sand pins 23 are attached to the frame 22 so as to be arranged in the back and forth direction. The support bracket 33 is provided to be mounted on the front-rear intermediate portions of the base parts 32. The support bracket 33 is formed in a U-shape in section opening rearward so as to extend right and left.

The weight mount portion 31 as described above can be attached to a portion of the frame 22 attached with the sand pins 23 by being co-fastened with the sand pins 23. In addition, the weight mount portion 31 can be attached to a portion of the frame 22 attached with no sand pin 23 by means of an associated bolt or the like. In short, the arbitrary number of the weight mount portions 31 can be installed at arbitrary places on the frame 22.

Figure 9:
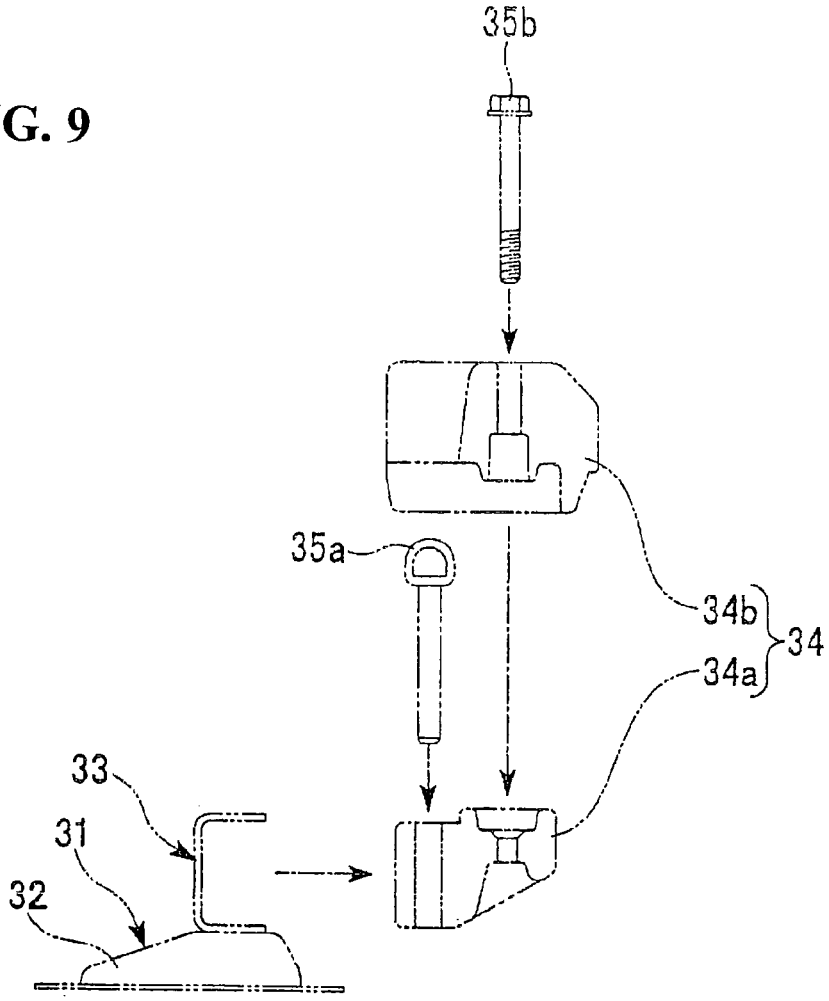
FIG. 9 is an exploded explanatory view of the weight mount portion of FIG. 6 and a weight attached thereto.

Additionally referring to FIG. 9, a weight 34 is configured to be dividable into a lower block 34*a* fitted to the support bracket 33 from the rearward and an upper block 34*b* fitted to the lower block 34*a* from above.

The lower block 34*a* is fixedly connected to the support bracket 33 by a retaining pin 35*a* passing up and down through the lower bracket 34*a* and the support bracket 33 with the front end portion of the lower block 34*a* fitted into the support bracket 33. The upper block 34*b* is fixedly connected to the lower block 34*a* by a connecting bolt 35 passing up and down through the upper block 34*b* and the lower block 34*a* with the lower portion of the upper block 34*b* conforming to the upper portion of the lower block 34*a*.

Figure 10:
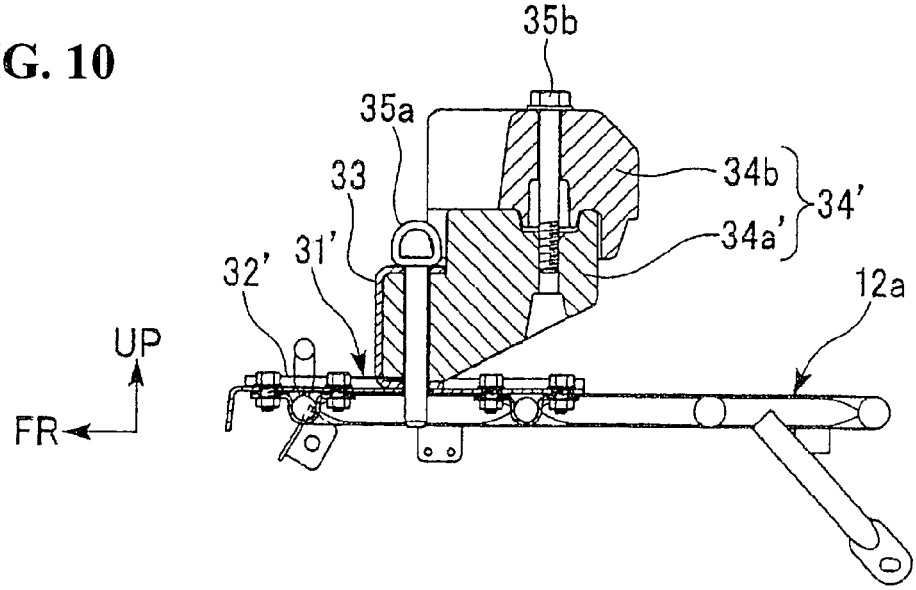
FIG. 10 is a side view of the weight mount portion attached to a front carrier of the towing vehicle.
Figure 11:
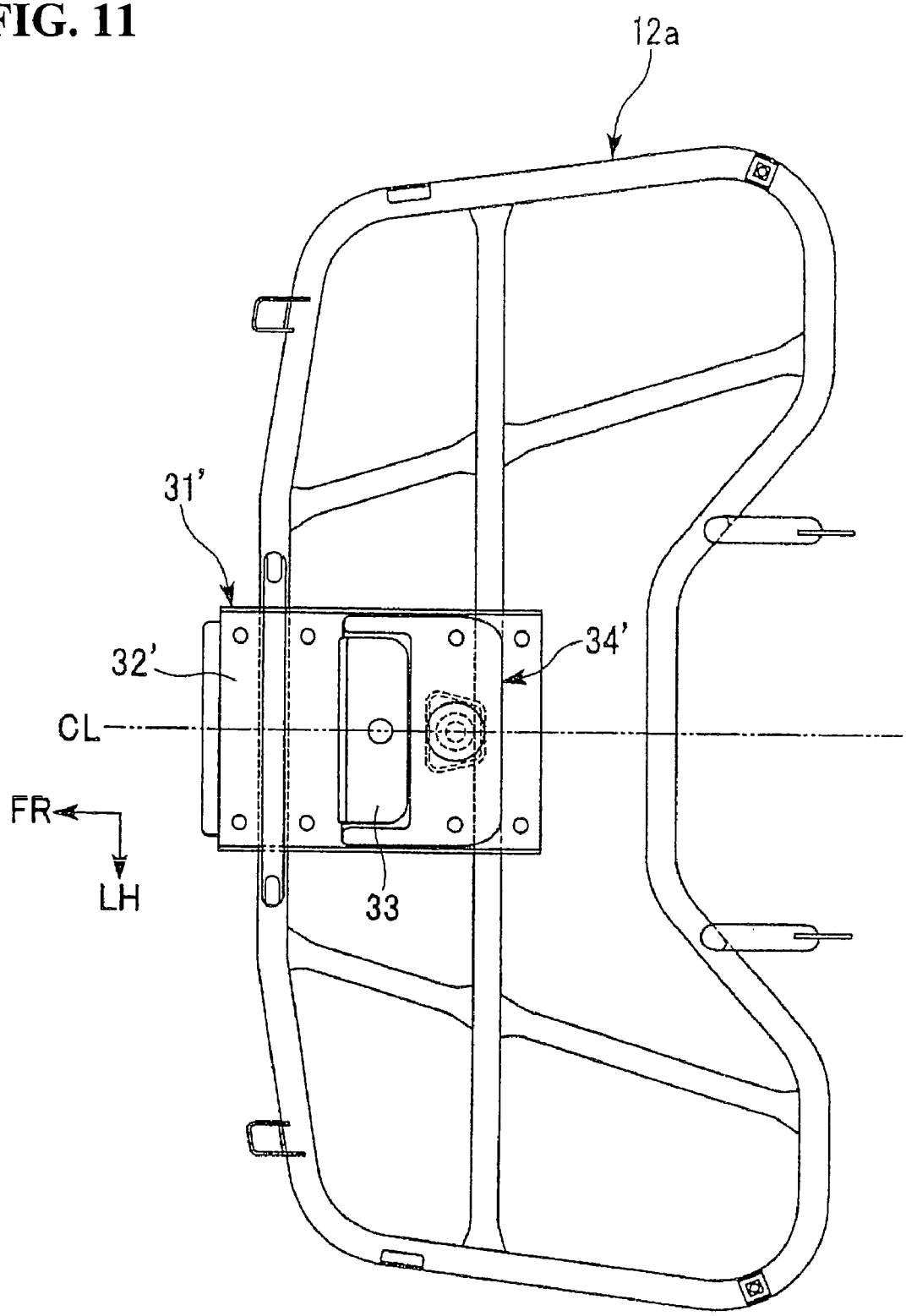
FIG. 11 is a plan view of FIG. 10.

Referring to FIGS. 10, 11, a desired weight mount portion 31' can be installed on the front carrier 12*a* of the vehicle 1 in order to ensure a load applied the front wheels for satisfactory driving force even if travel resistance is increased because of the weight 34 mounted on the first beach cleaner 20.

The weight mount portion 31' is integrally configured to include a base part 32' extending along the upper surface of the front carrier 12*a* and a support bracket 33, similar to that of the weight mount portion 31. The base part 32' is formed like a plate rectangular as viewed from the above and is detachably attached to pipe members at its front and rear lower surfaces. The pipe members extend in the leftward and rightward direction so as to constitute the front carrier 12*a*.

Figure 12:
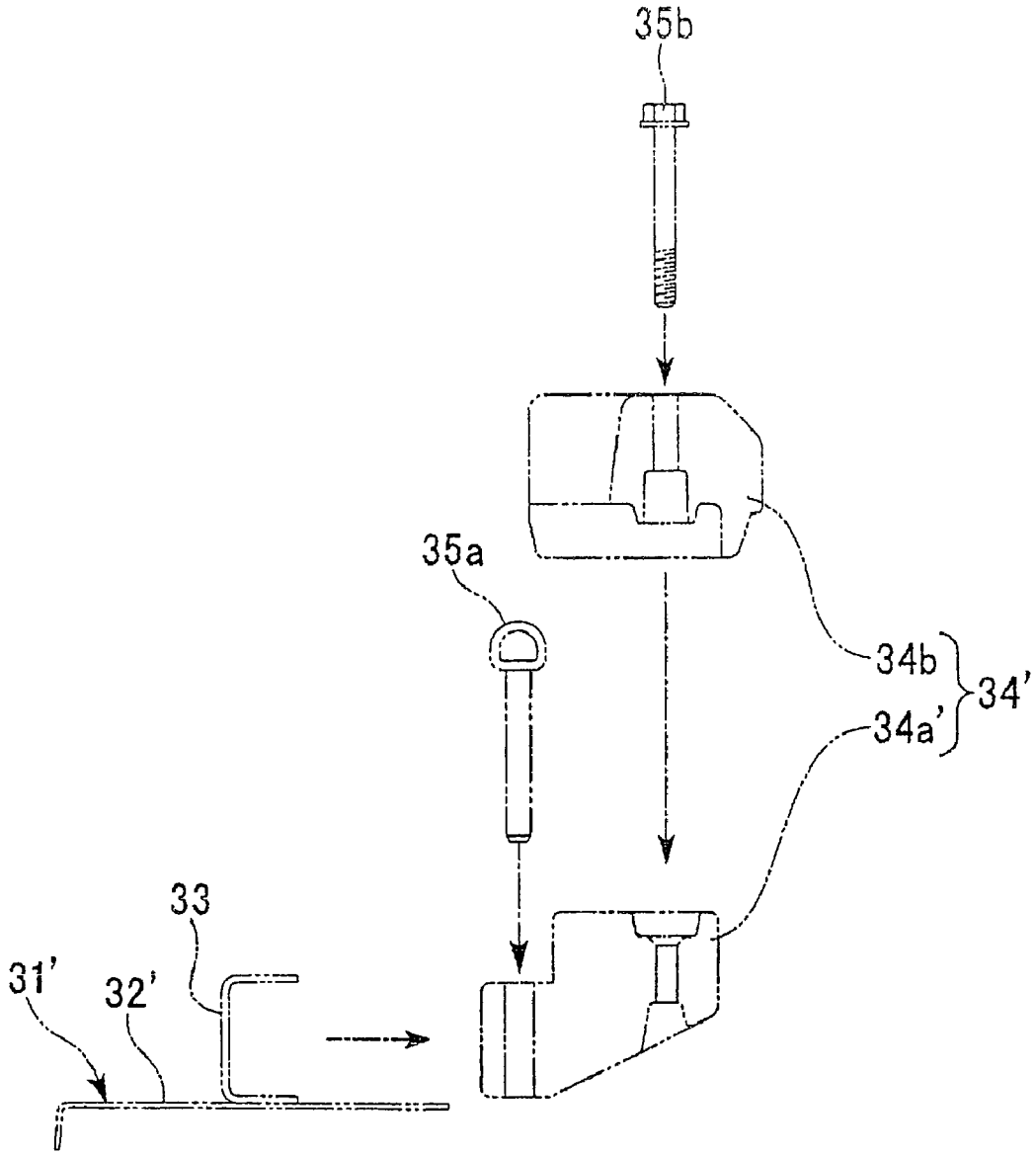
FIG. 12 is an exploded explanatory view of the weight mount portion of FIG. 10 and a weight attached thereto.

Additionally referring to FIG. 12, the weight 34' supported by the weight mount portion 31' is configured to be dividable into a lower block 34*a*' fitted into the support bracket 33 from the rearward and the upper block 34*b* fitted into the lower block 34*a*' from above.

The lower block 34*a*' has a slightly increased amount of rearward extension as compared with the lower block 34*a*. The front end portion of the lower block 34*a*' is fixedly connected to the support bracket 33 with the retaining pin 35*a*. While the lower portion of the upper block 34*b* conforms to the upper rear portion of the lower block 34*a*', the upper and lower blocks 34*a*', 34*b* are fixedly connected to each other with the connecting bolt 35*b*. The weight 34' is set in weight to a level greater than the weight 34. When the wheels spin free with respect to the sand, tire chains may be attached to the wheels.

Figure 25:
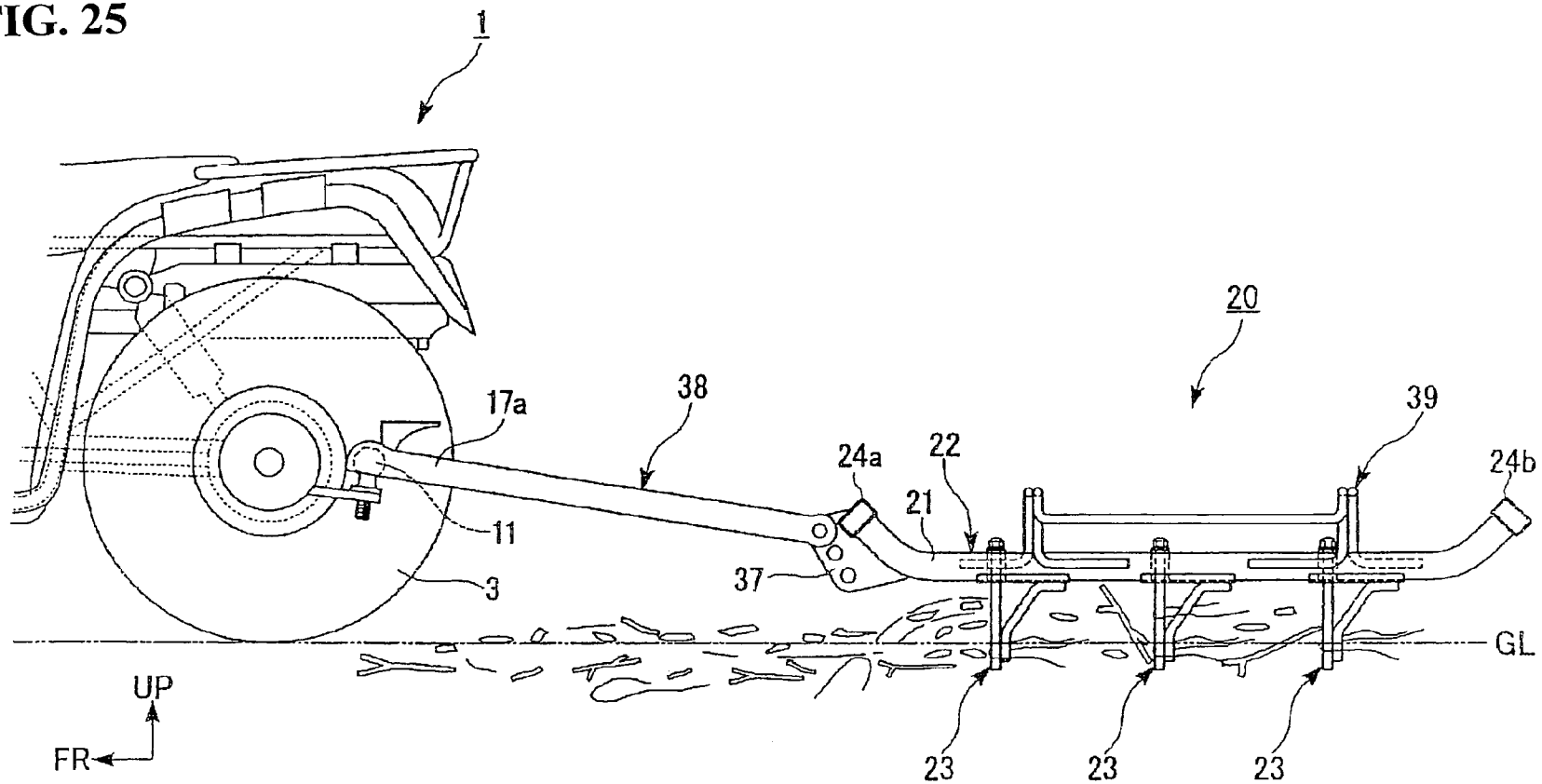
FIG. 25 is a side view illustrating a state where the first beach cleaner is towed by the vehicle.

With reference to FIGS. 2 and 3, a tow portion 37 used to by the vehicle 1 to pull the first beach cleaner 20 is provided in front of e.g. a third longitudinal member 21 from each of the left and right outside ends of the frame 22. The tow portion 37 is made of a thick plate extending perpendicular to the leftward and rightward direction and is formed with a plurality of (e.g. three) connecting holes 37*a* so as to be aligned along the inclination of the front end of the longitudinal member 21. One end of the tow rod 38 is connected to any one of the connecting holes 37*a*; the other end of the tow rod 38 is connected to the trailer hitch 11 of the vehicle 1. Thus the first beach cleaner 20 is towed by the vehicle 1 via the tow rod 38 (see FIG. 25).

In this case, the optimum towing position according to the digging of the first beach cleaner 20 into the sand can be set by connecting the one end of the tow rod 38 to which one of the connecting holes 37*a*. Additionally referring to FIG. 14, the tow rod 38 extends from the one end side coupled to the trailer hitch 11 toward the left and right tow portions 37 so as to be V- or Y-shaped as viewed from above. The hitch coupler 17*a* associated with the trailer hitch 11 is provided at the one end side.

Lift arms 39 are provided on the left and right outside of the frame 22 so as to protrude leftward and rightward, respectively, from the outside end of the frame 22. The lift arm 39 is formed like a horizontally long rectangular frame, for instance, as viewed from above. In the lift arm, the left-right intermediate portion is formed almost horizontally, the left-right inside portion is formed to bend obliquely downward and inward, and the left-right outside portion is formed to bend obliquely downward and outwardly. The left-right width between the outside ends of the left and right lift arms 39 is greater than the left-right width of the left and right side structures 41 of the waste recovery station 40. When the first beach cleaner 20 towed by the vehicle 1 enters between the left and right side structures 41, the left and right lift arms 39 ride on the left and right side structures 41, respectively, whereby the first beach cleaner 20 is lifted up at a desired amount. Incidentally, the distance between the left and right side structures 41 is greater than the left-right width of the vehicle 1, so that the vehicle 1 can pass between the left and right side structures 41.

Figure 13:
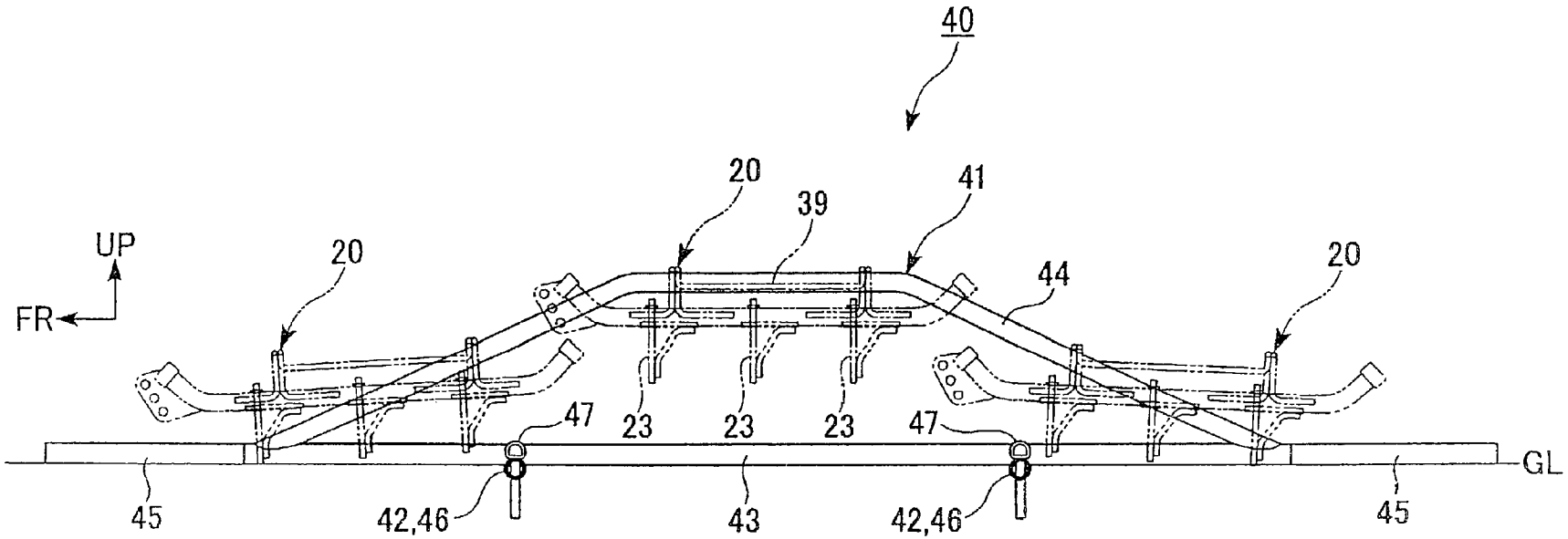
FIG. 13 is a side view of a waste recovery station according to the embodiment.
Figure 14:
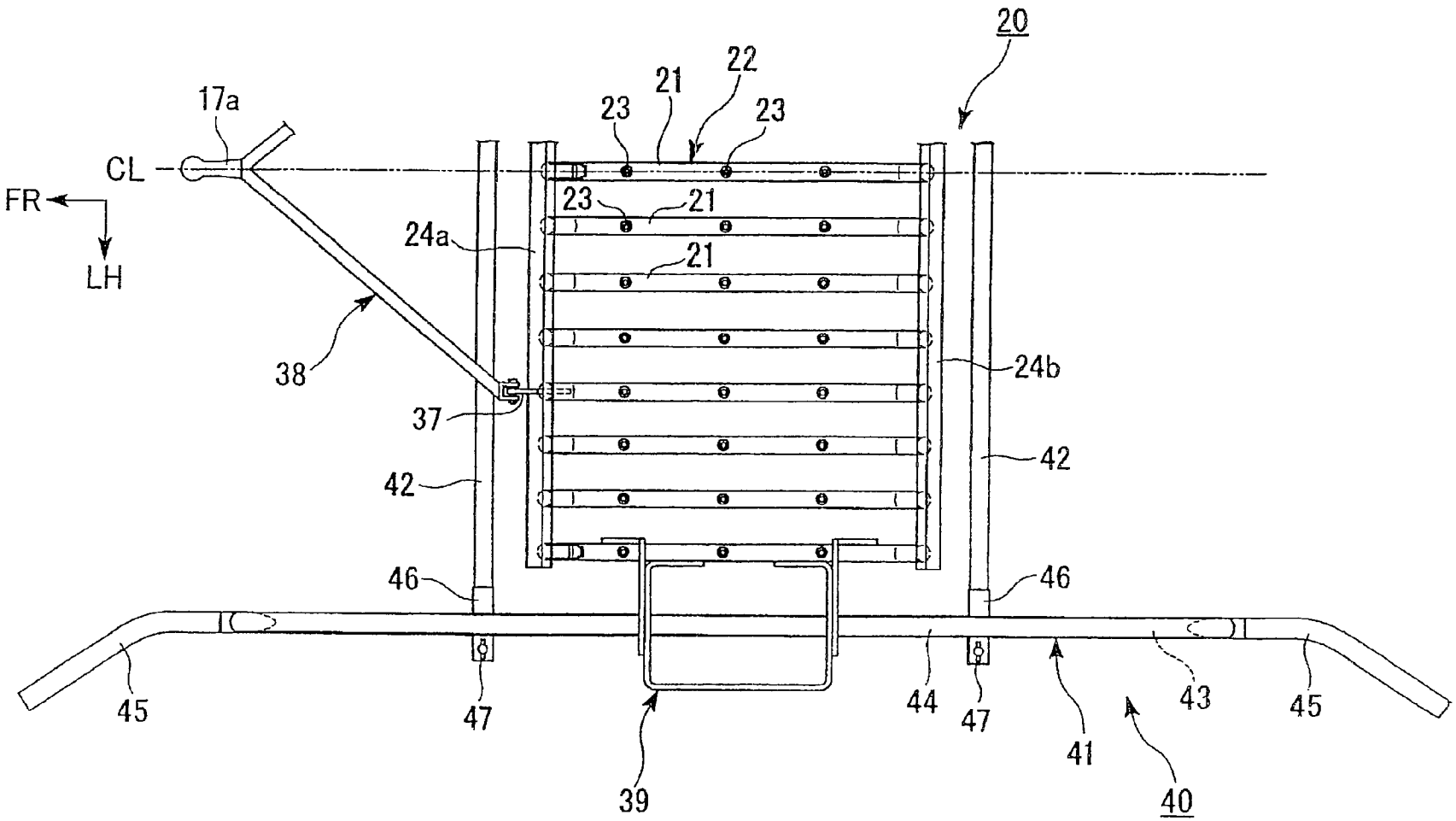
FIG. 14 is a plan view of FIG. 13.

Referring to FIGS. 13 and 14, when the first beach cleaner 20 is lift up on the waste recovery station 40, the sand pins 23 are sufficiently spaced apart from the upper surface of the sand area and the waste raked up by the sand pins 23 can be allowed to drop. Thus, the waste can be collectively recovered.

The waste recovery station 40 is configured by integrally connecting the left and right side structures 41 with a pair of front and rear connecting members 42. The waste recovery station 40 is configured to be symmetrical with respect to the front and rear thereof and to the left and right thereof for instance.

The left and right side structures 41 are each formed such that a guide member 44 is attached on a bar-like grounded member 43 and the front and rear ends of both the members 43, 44 are integrally coupled to each other. The guide member 44 is made of e.g. a circular steel tube and formed like a gentle mountain which is symmetrical with respect to the front and rear thereof as viewed from the side. The grounded member 43 is made of e.g. a circular steel tube and extends in the back and forth direction.

Foot members 45 are detachably attached to the front and rear ends of each of the left and right grounded members 45 so as to bend so that they are located further leftward or rightward outward as going forward or rearward as viewed from above. The foot members 45 are placed on the sand area together with the grounded members 43, whereby the waste recovery station 40 is stably installed while increasing its installation area.

Figure 15:
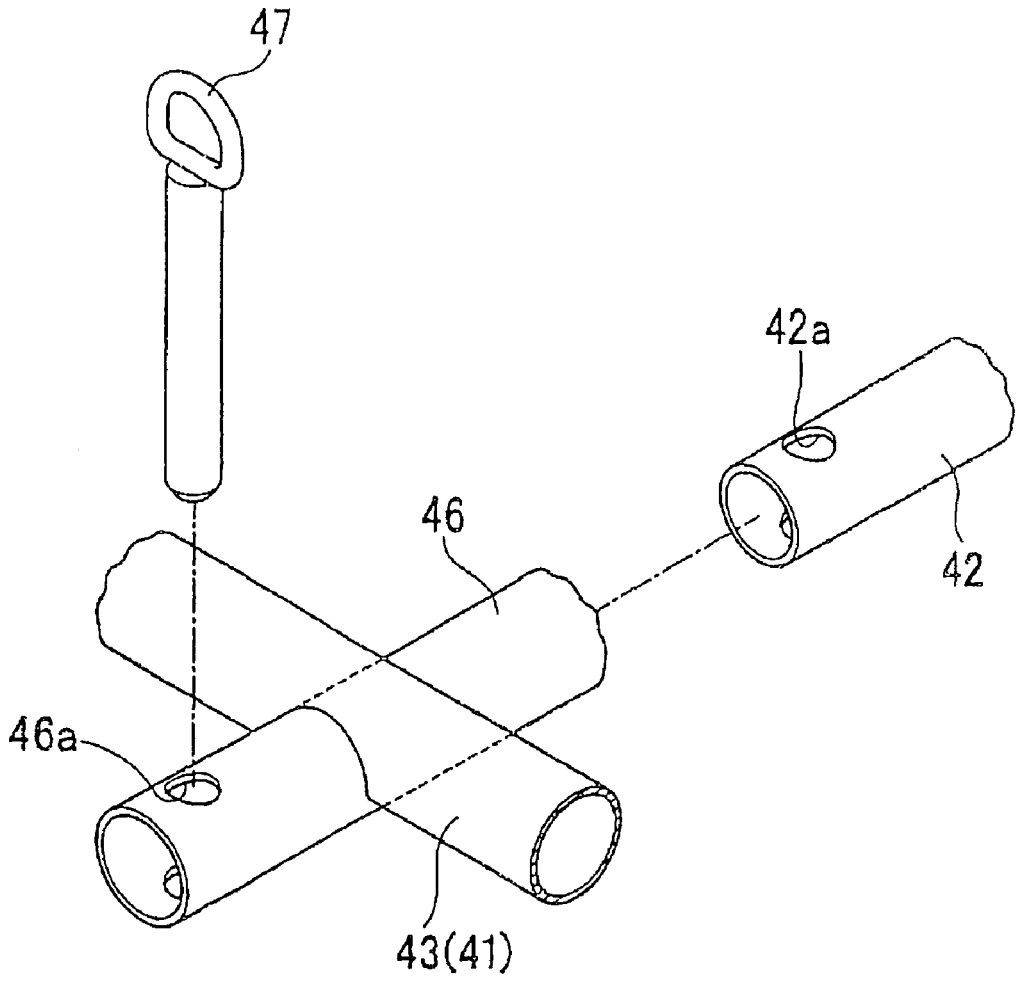
FIG. 15 is a perspective view for assistance in explaining the dividing structure portion of the waste recovery station.

Additionally referring to FIG. 15, the connecting member 42 is made of e.g. a circular steel tube and extends in the leftward and rightward direction. An end of the connecting member 42 is detachably inserted into a connection pipe 46 disposed under each of the front or rear portions of the grounded member 43. In this state, the left and right side structures 41 are integrally connected to each other. In other words, since the waste recovery station 40 has a relatively large size, it is made dividable into a plurality of divided bodies (the left and right side bodies 41 and the front and rear connecting members 42).

The connecting pipe 46 associated with the grounded member 43 is made of a relatively short circular steel tube and extends in the leftward and rightward direction. The connecting pipe 46 is integrally connected to the grounded member 43 in such a manner that its upper external circumference conforms to the lower notch of the grounded member 43. In other words, the connecting pipe 46 projects downwardly from the lower surface of the grounded member 43. When the waste recovery station 40 is installed on the sand area, the connecting pipes 46 dig into sand to suppress movement of the waste recovery station 40.

An end of the connecting member 42 is inserted into the connecting pipe 46 at a predetermined amount, thereby providing an assembled state (for example, a state where the outer edge of the connecting pipe 46 is made to coincide with the outer edge of the connecting member 42). In this state, upper and lower through-holes 46*a* formed in the connecting pipe 46 are respectively superposed on upper and lower through-holes 42*a* formed in the connecting member 42 at positions on the leftward and rightward oust side of the grounded member 43 for example. A desired retaining pin 47 is inserted into the upper and lower through-holes 42*a*, 46*a* to unremovably connect the connecting member 42 with the grounded member 43 in the assembled state.

The retaining pin 47 passes through the connecting member 42 and the connecting pipe 46, further projecting downwardly, and is dug into sand at a desired amount. Thus, the retaining pins 47 suppress movement of the waste recovery station 40 from the predetermined installation site. If the retaining pins 47 are removed and the connecting members 42 are detached from the connecting pipes 46, the waste recovery station 40 can be divided into the left and right side structures 41 and the front and rear connecting members 42.

Figure 16:
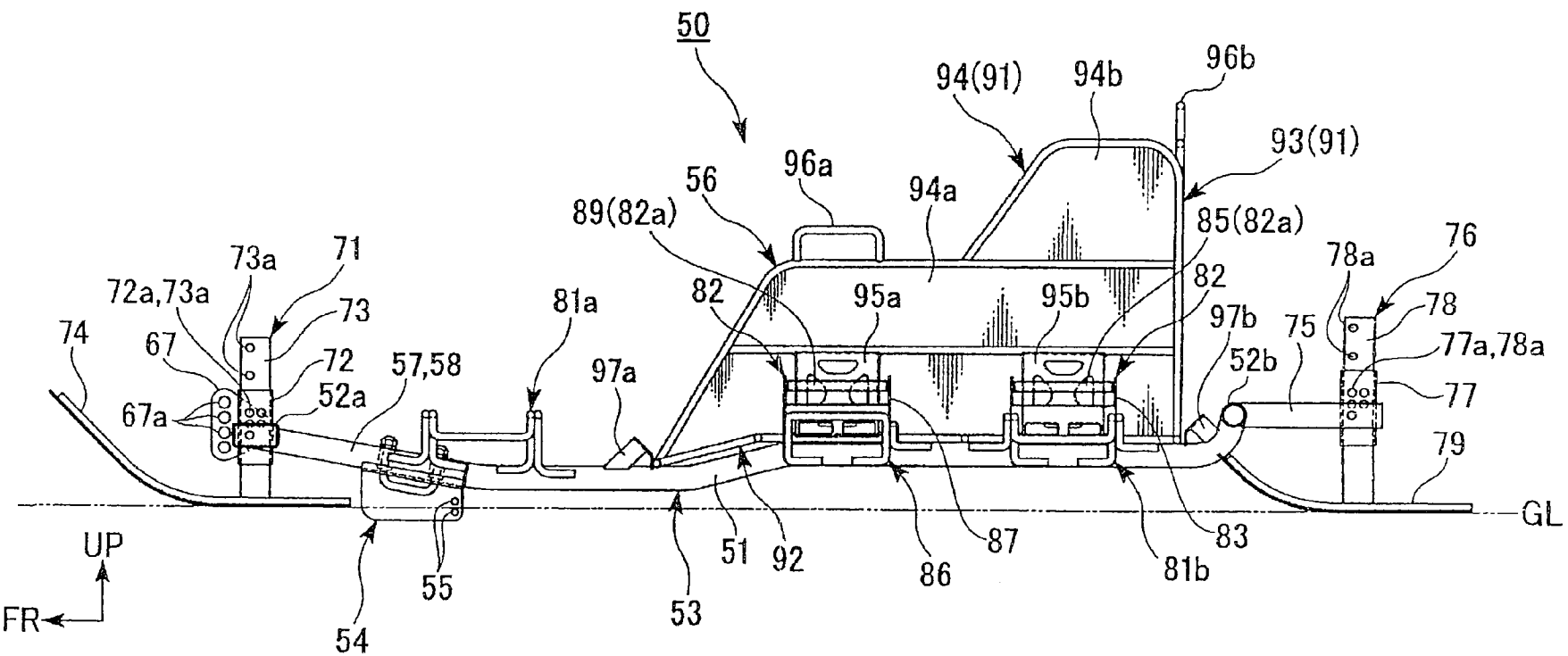
FIG. 16 is a side view of a second beach cleaner according to the embodiment.
Figure 17:
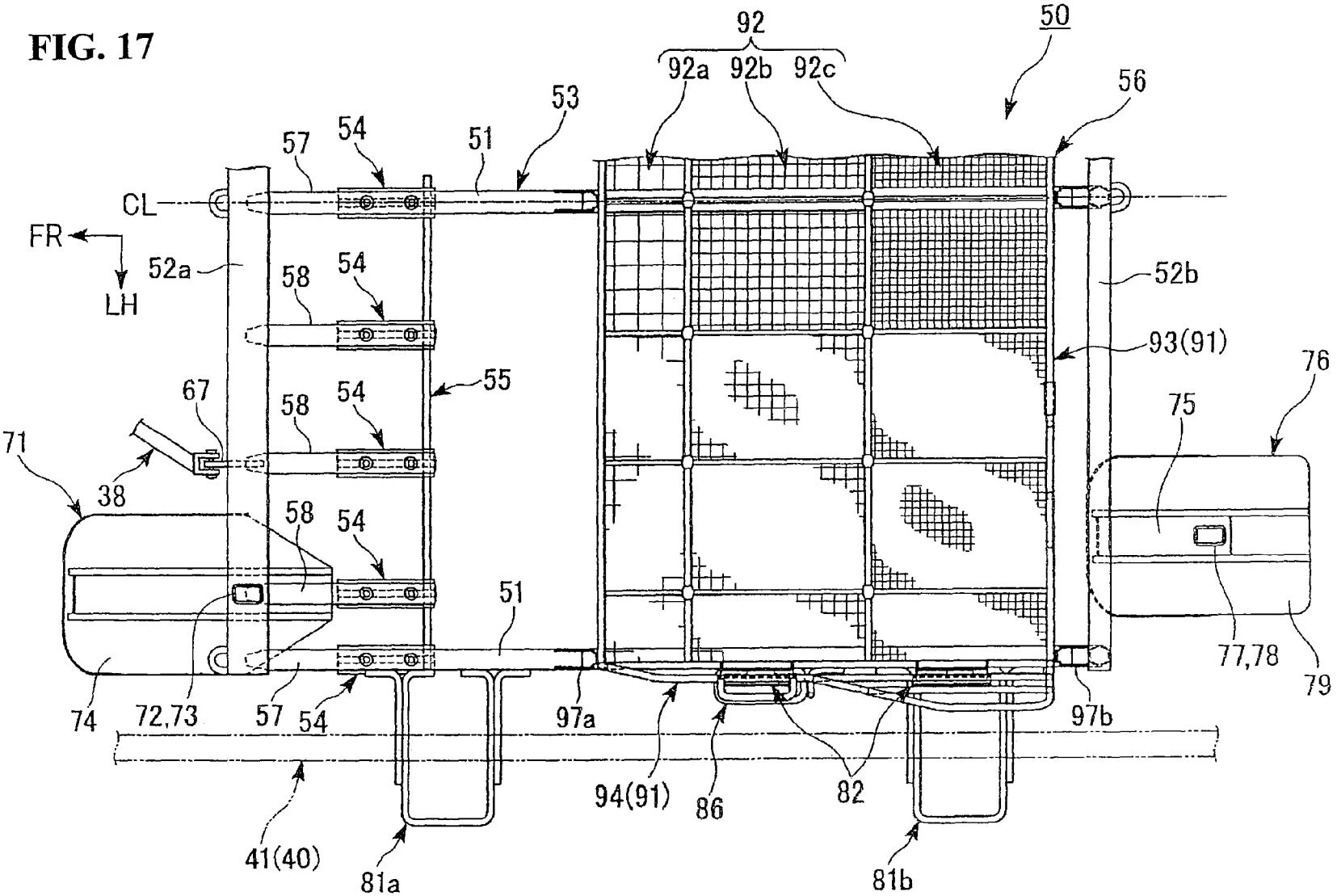
FIG. 17 is a plan view of FIG. 16.

Referring to FIGS. 16 and 17, the second beach cleaner 50 mainly includes a plurality of (e.g. three) longitudinal members 51 extending in the traveling direction of the vehicle; and front and rear lateral members 52*a*, 52*b* extending in the widthwise direction (the leftward and rightward direction) so as to be perpendicular to the longitudinal members 51. The longitudinal members 51 and the lateral members 52*a*, 52*b* form a frame 53. The frame 53 is provided at its front portion with keels 54 and scrapers 55 described later and at its rear portion with a net 56 described later. The second beach cleaner 50 is also configured to be symmetrical.

The longitudinal member 51 is made of e.g. a circular steel tube and extends in the back and forth direction. The longitudinal member 51 is moderately cranked at its intermediate portion as viewed from the side so that its rear portion is shifted slightly upward from the front portion thereof. A central portion of the front portion of the longitudinal member 51 moderately bends so that a front half portion of the front portion is provided to slant forwardly and slightly upwardly. The front half portion of the front portion of the longitudinal member 51 is hereinafter referred to as the front slant portion 57. On the other hand, the rear end of the longitudinal member 51 is provided to bend upwardly. The longitudinal member 51 may be made of a rectangle steel tube.

A plurality of the longitudinal members 51 are juxtaposed left and right so as to be superposed as viewed from the side. The longitudinal member 51 is abutted at its front end against the front lateral member 52*a* from the rearward for connection therewith. The front lateral member 52*a* is made of e.g. a rectangular steel tube and extends in the leftward and rightward direction. In addition, the longitudinal member 51 is abutted its rear end against the rear lateral member 52*b* from below for connection therewith. The rear lateral member 52*b* is made of e.g. a circular steep tube and extends in the leftward and rightward direction. The frame 53 mainly including the longitudinal members 51 and the lateral members 52*a*, 52*b* is formed in an almost-square as viewed from above. Incidentally, the frame 53 has a left-right width approximately equal to that of the frame 22 of the first beach cleaner 20.

A plurality of (e.g. three) scraper frames 58 are juxtaposed left and right between a central longitudinal member 51 and each of left-end and right-end longitudinal members 51 so as to be superposed on the front slant portions 57 as viewed from the side. The scraper frame 58 is made of a circular steel tube (which may be a rectangular steel tube) having the same diameter as that of the longitudinal member 51. The scraper frame 58 is abutted at its front end against the front lateral member 52*a* from the rearward for connection therewith. On the other hand, the rear end of the scraper frame 58 is not connected to any members, that is, serves as a free end. The scraper frames 58 and the central longitudinal member 51 are spaced equally apart from each other. The outermost left scraper frame 58 and the left longitudinal member 51, and the outermost right scraper frame 58 and the right longitudinal member 51, are each arranged to have narrow spacing therebetween.

The keels 54 and scrapers 55 are attached to the front slant portions 57 of the longitudinal members 51 and to the scraper frames 58. The keels 54 and scrapers 55 serve as a raking-up portion which rakes up sand and relatively small waste (drink boxes, paper scraps, cigarette butts, etc.) while the second beach cleaner 50 travels, being towed.

Figure 19:
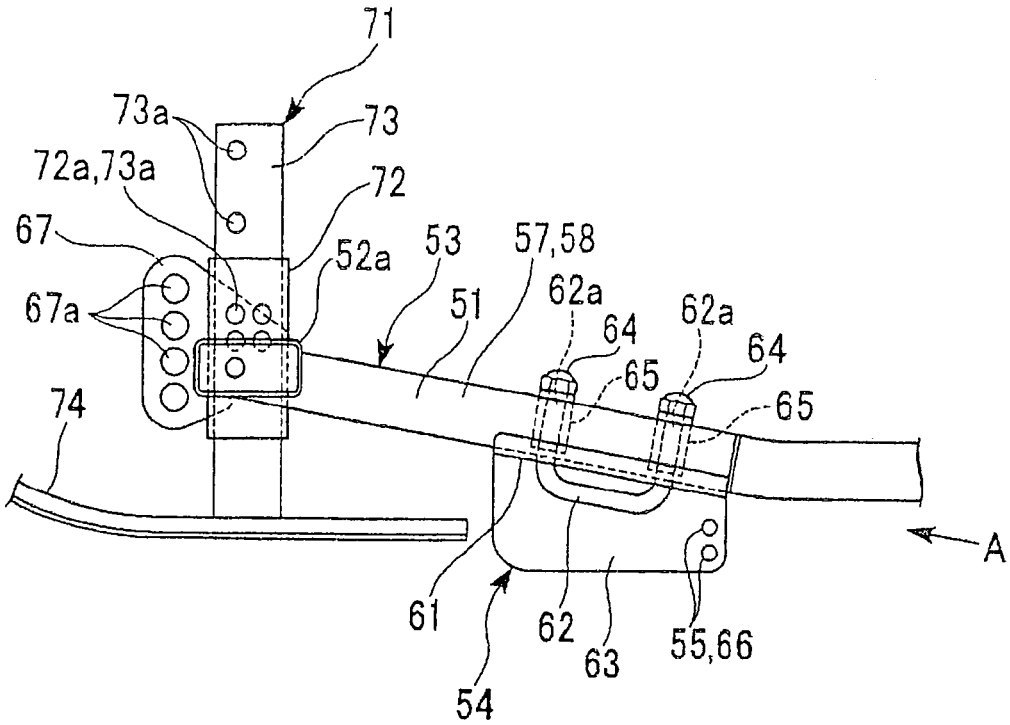
FIG. 19 is a side view of the front portion of the frame of the second beach cleaner.
Figure 20:
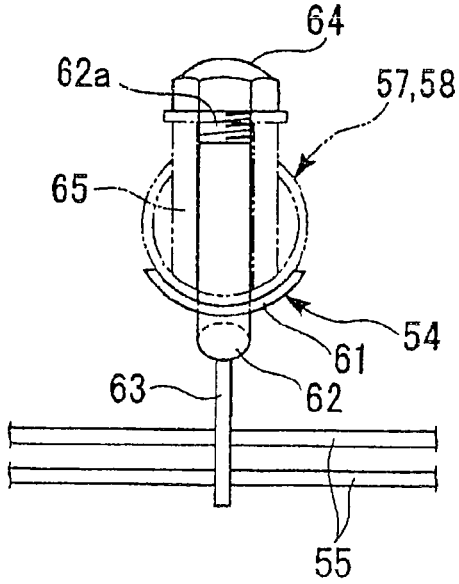
FIG. 20 is a view as viewed from arrow A of FIG. 19.

Additionally referring to FIGS. 19 and 20, the keel 54 is detachably attached to the rear portion of the front slant portion 57 of the longitudinal member 51 and to the rear portion of the scraper frame 58. The keel 54 includes a plate-like member 61, a U-shaped pin 62 and a keel main body 63. The plate-like member 61 bends to conform to the lower outer surface of the front slant portion 57 or the scraper frame 58. The U-shaped pin 62 is formed in a U-shape opening upward and has both side portions passing through the plate-like member 61. The keel main body 63 is formed like a plate to extend almost perpendicularly to the leftward and rightward direction and extends downward from the lower edge of the plate-like member 61.

The upper parts of both side portions of the U-shaped pin 62 are formed as external thread parts 62*a*. The external thread parts 62*a* pass through the front slant portion 57 or the scraper frame 58 from below to project upward therefrom. In this state, the plate-like member 61 abuts against the lower surface of the front slant portion 57 or the scraper frame 58. In this state, a hexagon cap nut 64 is threaded on each of the external thread parts 62*a* and fastened thereto, whereby the keel 54 is fastened to the front slant portion 57 or the scraper frame 58. A cylindrical collar 65 is fixedly inserted through a portion, of the front slant portion 57 or the scraper frame 58, through which each of the side portions of the U-shaped pin 62 passes.

The keel 54 (the keel main body 63) is formed at its rear end with a plurality of scraper support holes 66, by which the scrapers 55 is insertably supported. The scraper 55 is formed like a bar circular in section for instance and extends in the leftward and rightward direction. The scrapers 55 extend across the keels 54 while insertably supported by the upper and lower support holes 66. The scrapers 55 can be selectively supported according to the conditions of the sandy beach and waste and the plurality of scrapers can be supported. To prevent the scrapers 55 from falling from the respective keels 54, the scrapers 55 are provided at their ends with locking devices such as desired retaining pins inserted thereto. The sectional shape of the scraper 55 is not limited to a circle but may be of a semicircle with an upper surface extending forwardly downwardly. The scraper 55 may be one, three or more. In addition, the scrapers may be arranged not above and below but right and left or obliquely.

The keels 54 and the scrapers 55 are set so as to be dug into sand at an appropriate depth. While the second beach cleaner 50 runs in this state, the keels 54 push aside sand and waste and the scrapers 55 scrape up them. In this way, the sand and waste thus scraped up are thrown into the net 56 provided at the rear portion of the frame 53.

Figure 26:
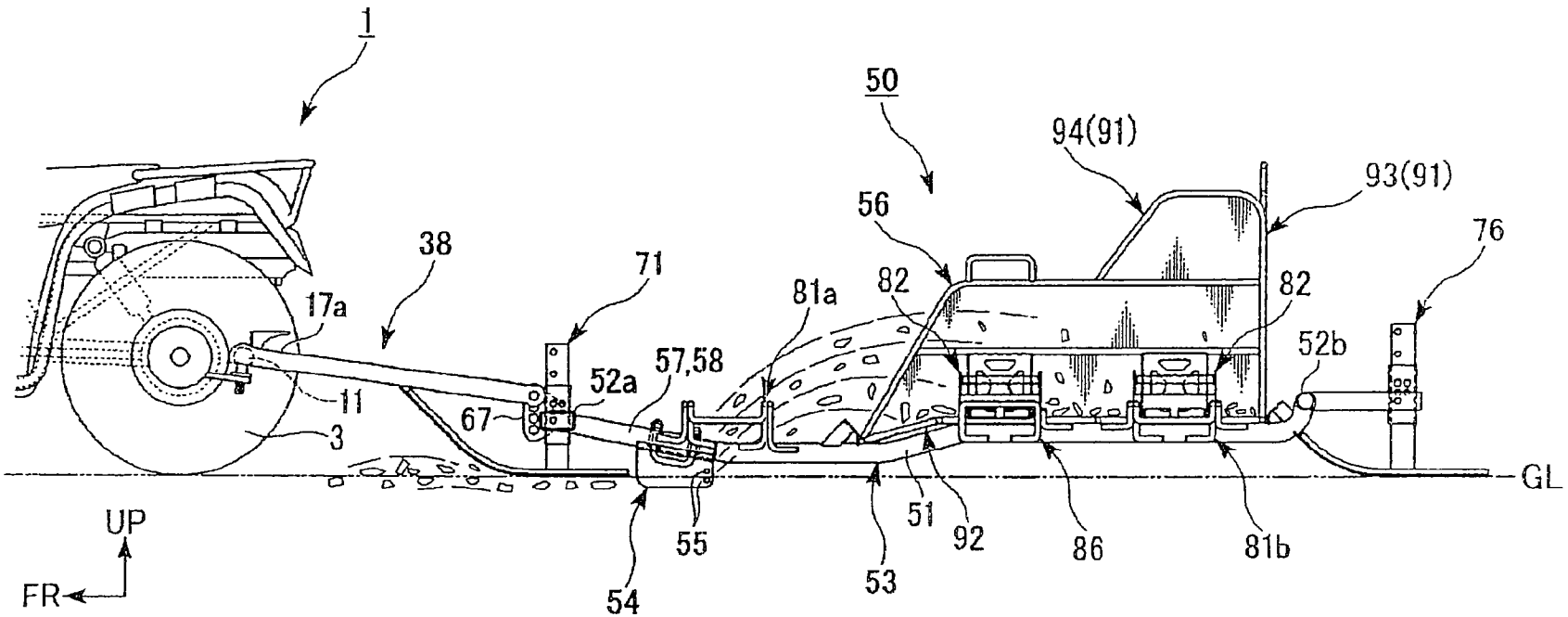
FIG. 26 is a side view illustrating a state where the second beach cleaner is towed by the vehicle.

With reference to FIGS. 16 and 17, a tow portion 67 is provided in front of e.g. a second scraper frame 58 from each of the left and right outside ends of the frame 53. The tow portion 67 is used by the vehicle 1 to pull the second beach cleaner 50. The tow portion 67 is made of a thick plate extending perpendicular to the leftward and rightward direction and is formed with a plurality of (e.g. four) connecting holes 67*a* arranged up and down. One end of the tow rod 38 is connected to any one of the connecting holes 67*a*; the other end of the tow rod 38 is connected to the trailer hitch 11 of the vehicle 1. Thus the second beach cleaner 50 is towed by the vehicle 1 via the tow rod 38 (see FIG. 26).

In this case, the optimum towing position according to the ground height of the second beach cleaner 50 can be set by connecting the one end of the tow rod 38 with which one of the connecting holes 67*a*. The left-right distance between the left and right tow portions 67 is approximately equal to that between the left and right tow portions 37.

A front ski support pipe 72 supporting a front ski leg 71 is provided, for instance, forward of each of the left and right outermost scraper frames 58 included in the frame 53. The front ski support pipe 72 is made of e.g. a rectangular steel tube and passes through the front lateral member 52*a* vertically. The front ski support pipe 72 can supportably pass a leg member 73 of the front ski leg 71 therethrough. The leg member 73 is also made of a rectangular steel tube. The front ski leg 71 is adapted to set the ground height (the height from the upper surface of the sand area) of the front portion of the second beach cleaner 50 and to enhance glide performance relative to the sand area. The front ski leg 71 includes a front ski plate 74 with a predetermined width having a front portion bending forwardly upwardly and the leg member 73 provided on the front ski plate 74 so as to extend upright.

The front ski support pipe 72 is formed with left and right through-holes 72*a*. The leg member 73 is formed with a plurality of (e.g. four) left and right through-holes 73*a* arranged up and down so as to correspond to the left and right through-holes 72*a*. Any one of the left and right through-holes 73*a* is superposed on one of the left and right through-holes 72*a* of the front ski support pipe 72 and a predetermined retaining pin or the like is inserted into the through-holes thus superposed. This determines the height of the front portion of the frame 53 relative to the front ski leg 71, whereby the ground height of the front portion of the second beach cleaner 50 is set at a desired level. In other words, the ground height of the front portion of the second beach cleaner 50 can be adjusted by inserting the retaining pin or the like into which one of the left and right through-holes 73*a* of the leg member 73. Thus, the amount of digging the keels 54 and the scrapers 55 into sand can be adjusted.

An extension frame 75 made of e.g. a rectangular steel tube extends from a rear portion, on each of both sides, of the rear lateral member 52*b*. A rear ski support pipe 77 is provided at the rear end of the extension frame 75 so as to support a rear ski leg 76. The rear ski support pipe 77 is made of e.g. a rectangular steel tube and passes through the extension frame 75 upwardly and downwardly. The rear ski support pipe 77 can supportably pass a leg member 78 of the rear ski leg 76 therethrough. The leg member 78 is also made of a rectangular steel tube. The rear ski leg 76 has the same configuration and function as the front ski leg 71. That is to say, the rear ski leg 76 is provided on a rear ski plate 79 so as to extend the leg member 78 upright.

The rear ski support pipe 77 is formed with a single left-right through-hole 77*a*. The leg member 78 is formed with a plurality of (e.g. four) left-right through-holes 78*a* arranged up and down so as to correspond to the left-right through-hole 77*a*. Any one of the left-right through-holes 78*a* is superposed on the left-right through-hole 77*a* of the rear ski support pipe 77 and a predetermined retaining pin or the like is inserted into the through-holes thus superposed. This determines the height of the rear portion of the frame 53 relative to the rear ski leg 76, whereby the ground height of the rear portion of the second beach cleaner 50 is set at a desired level. (In other words, the ground height of the rear portion of the second beach cleaner 50 can be adjusted.) The left-right width between the outer ends of the front ski plates 74 of the left-right front ski legs 71 is made approximately equal to the left-right width of the frame 53. The left-right width between the outer ends of the rear ski plates 79 of the left and right rear ski legs 76 is made smaller than the left-right width of the frame 53.

Front lift arms 81*a* are provided on the left and right outside of the front portion of the frame 53 so as to protrude leftward and rightward, respectively. Rear lift arms 81*b* are provided on the left and right outside of the rear portion of the frame 53 so as to protrude leftward and rightward, respectively. The lift arms 81*a*, 81*b* are each formed like a horizontally long rectangular frame, for instance, as viewed from above. In each lift arm, the left-right intermediate portion is formed almost horizontally, the left-right inside portion is formed to bend obliquely downward and inward, and the left-right outside portion is formed to bend obliquely downward and outwardly. The left-right width between the outside ends of each of the lift arms 81*a*, 81*b* is greater than the left-right width between the left and right side structures 41R, 41L of the waste recovery station 40, (that is, is approximately equal to the left-right width of the frame 22 of the first beach cleaner 20.) When the second beach cleaner 50 enters between the left and right side structures 41L, 41R, the lift arms 81*a* and 81*b* ride on the left and right side structures 41, respectively, whereby the second beach cleaner 50 is lifted up at a desired amount.

When the second beach cleaner 50 is lifted up as described above in the waste recovery station 40, the net 56 provided at the rear portion of the frame 53 is elevated to a desired height. The net 56 is made to be turned around a hinge 82 located on the left side thereof (see FIG. 18). Thus, the recovery work of the waste gathered in the net 56 can be facilitated. Incidentally, for the second beach cleaner 50, the waste recovery work can be carried out with the second beach cleaner 50 not lifted up, that is, placed on the ground.

Figure 21:
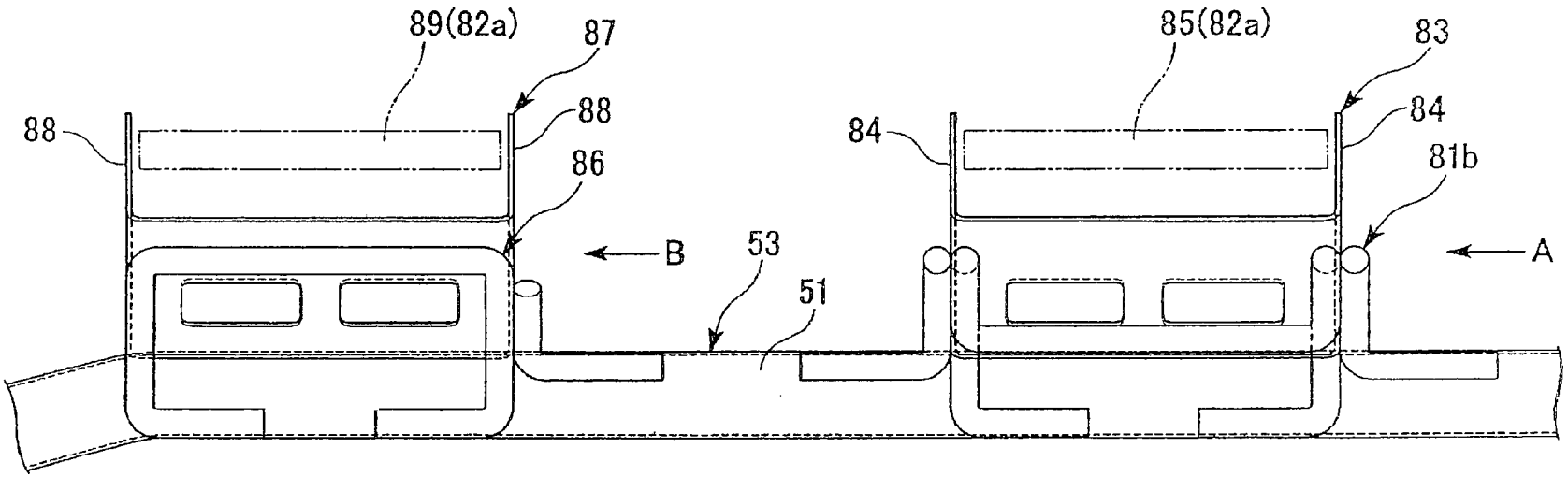
FIG. 21 is a side view illustrating the periphery of hinges for a net of the second beach cleaner.
Figure 22A:
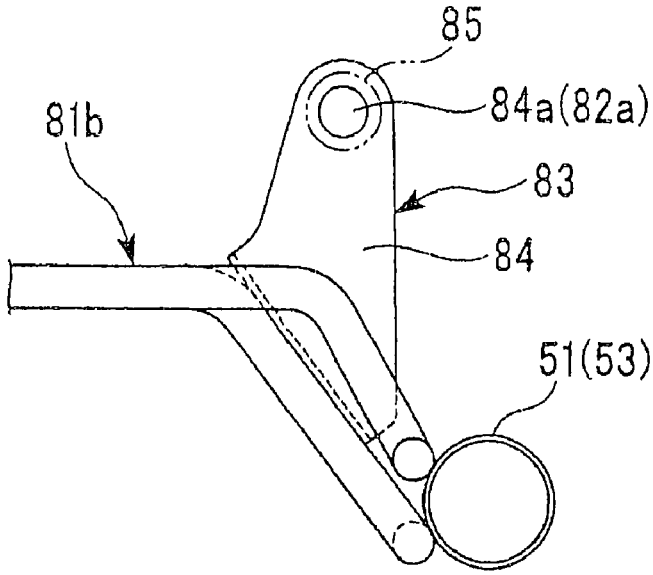
FIG. 22(*a*) is a view as viewed from arrow A of FIG. 21, and FIG. 22(*b*) is a view as viewed from arrow B of FIG. 21.
Figure 22B:
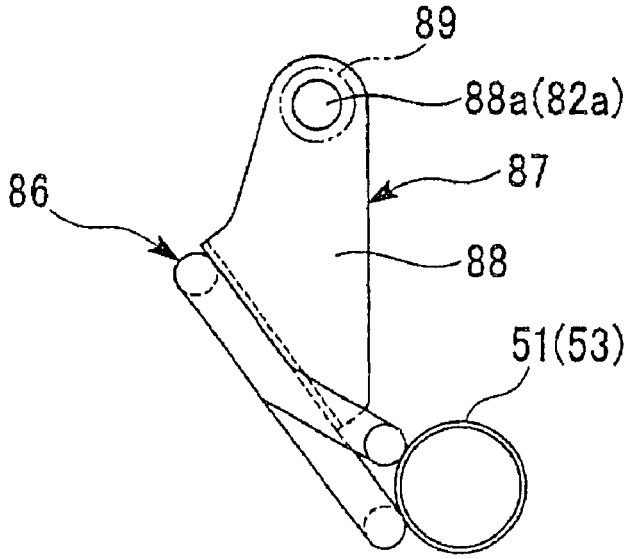

Additionally referring to FIGS. 21 and 22, a rear hinge bracket 83 is attached to the rear lift arm 81*b* located on the left side portion of the frame 53. The rear hinge bracket 83 constitutes part of a hinge 82 pivotally supporting the left side of the net 56. The rear hinge bracket 83 extends across the front and rear of the rear lift arm 81*b* on the proximal end thereof. The rear hinge bracket 83 is formed at its front and rear ends with front and rear walls 84, respectively, which extend upward. The front and rear walls 84 are formed on the leading end side with front and rear through-holes 84*a*, respectively, adapted to receive a hinge shaft 82*a*. A rear hinge pipe 85 provided on the left side of the net 56 so as to be associated with the rear hinge bracket 83 is disposed between the front and rear walls 84. The rear hinge pipe 85 is pivotally supported by the rear hinge bracket 83 via the hinge shaft 82*a* extending in the back and forth direction.

A frame-like support arm 86 is provided slightly forward of the rear lift arm 81*b*. The support arm 86 has a slightly smaller left-right width than the lift arm 81*b*. A front hinge bracket 87 having the same configuration as the rear hinge bracket 83 is supported by the support arm 86. Front and rear walls 88 of the front hinge bracket 87 is formed with front and rear through-holes 88*a*, respectively, adapted to receive a hinge shaft 82*a*. A front hinge pipe 89 provided on the left side of the net 56 so as to be associated with the front hinge bracket 87 is disposed between the front and rear walls 88. The front hinge pipe 89 is pivotally supported by the front hinge bracket 87 via the hinge shaft 82*a* extending in the back and forth direction. The hinge pipes 85, 89 and the hinge shaft 82*a* are provided coaxially with each other.

Referring to FIGS. 16 and 17, the net 56 is formed in a box shape opening forward and upward and includes a frame mainly made of e.g. steel pipes and wire meshes with meshes of desired sizes attached to the steel pipes. This net 56 is provided so as to extend from a position slightly forward of the center of the frame 53 to the vicinity of the rear end of the frame 53 in the back and forth direction. In addition, the net 56 is provided to have the left-right width approximately equal to that of the frame 53 in the leftward and rightward direction. The front end of the net 56 is spaced apart about 100 to 300 mm from the vicinity of the rear ends of the keels 54, namely, the vicinity of the scrapers 55 in order to make it possible to satisfactorily capture the sand and waste scraped up by the keels 54 and the scrapers 55. The front end of the net 56 is more preferably spaced apart about 250 mm from the vicinity of the rear ends of the keels 54 rearward.

Figure 18:
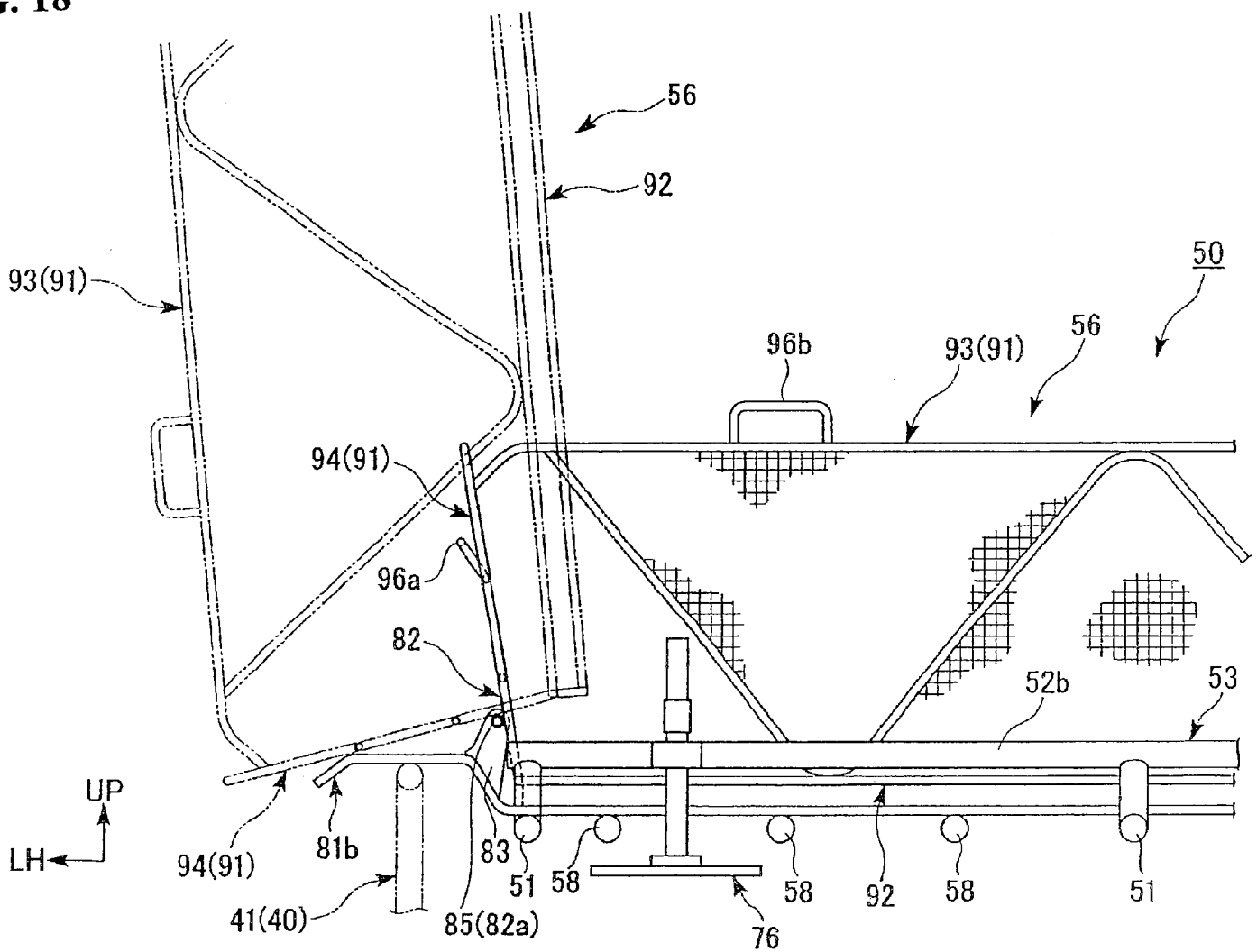
FIG. 18 is a rear view of FIG. 16.

Additionally referring to FIG. 18, the net 56 includes a bottom wall section 92, a rear wall section 93 and left and right side wall sections 94. The bottom wall section 92 is formed in a horizontally long rectangle as viewed from above. The rear wall section 93 is formed to rise almost upright from the rear edge of the bottom wall section 92. The left and right side wall sections 94 slightly obliquely rise from both side edges of the bottom wall section 92 so as to be located leftward and rightward outwardly, respectively, as they go upward. The rear wall section 93 and the left and right side wall sections 94 form a surrounding section 91 which surrounds the circumference of the bottom wall section 92 except the front thereof in order to make it possible to collect the waste scraped by the keels 54 and the scrapers 55.

The front portion of the bottom wall section 92 is a slant section 92*a* which slants slightly forwardly downwardly. A portion rearward of the slant section 92*a* is a horizontal portion extending almost horizontally. The horizontal portion is divided into a front horizontal section 92*b* and a rear horizontal section 92*c* by a lateral member extending in the leftward and rightward direction.

A wire mesh with a mesh size of 25 mm is attached to the slant section 92*a* of the bottom wall section 92. A wire mesh with a mesh size of 12 mm is attached to the front horizontal section 92*b*. A wire mesh with a mesh size of 8 mm is attached to the rear horizontal section 92*c*.

As described above, the wire mesh of the bottom wall section 92 is set larger in mesh size as it goes forward. The relatively heavy damp sand of the sand scraped by the keels 54 and the scrapers 55 does not reach the rear portion of the bottom wall section 92. Thus, the relatively heavy damp sand is satisfactorily eliminated, without occurrence of clogging, through the wire mesh with large meshes at the front portion of the slant section 92*a* of the bottom wall section 92. On the other hand, relatively lightweight dry sand and the like reach the horizontal section of the rear side portion of the bottom wall section 92, where they are eliminated through the wire meshes with middle and small meshes attached thereto but the waste is satisfactorily captured without being eliminated through the wire meshes. Incidentally, the wire meshes may be arbitrarily replaceable in the mesh sizes of about 6, 8, 10, 12 and 25 mm.

A side wall section 94 of the net 56 includes a side wall main body 94*a* and a rear projecting section 94*b*. The side wall main body 94*a* is formed on each of side edges of the bottom wall section 92 so as to be in a rectangle long in the back and forth direction as viewed from the side. The rear projecting section 94*b* is formed on the rear side portion of the side wall main body 94*a* so as to be in a trapezoid as viewed from the side. The respective rear side portions of the side wall main body 94*a* and the rear projecting section 94*b* are extend vertically as viewed from the side so as to be linearly contiguous to each other. The rear wall section 93 of the net 56 is provided such that the rear side portions serve as its lateral side portions. The upper side portion of the side wall section 94 (rear projecting section 94*b*) is approximately equal in height to the upper side portion of the rear wall section 93.

Front and rear hinge plates 95*a*, 95*b* are provided at front and rear portions, respectively, of the left side wall section 94 of the net 56 so as to be spanned between the intermediate and lower frame members of the side wall main body 94*a*. Each of the hinge plates 95*a*, 95*b* is formed like a plate shaped in an almost square as viewed from the side. Each of the hinge plates is appropriately cut out to leave its outer edge portion and orthogonal portions. In addition, the front and rear edge portions of each of the hinge plates 95*a*, 95*b* are bent leftward and rearward inwardly to form reinforcing flanges. The front and rear hinge pipes 85 and 89 are integrally joined to the outer side surfaces of the hinge plates 95*a* and 95*b*, respectively.

A grip 96*a* is provided at a front upper side (above the front hinge plate 95*a* in the left side wall section 94) of each of the left and right side wall sections 94 so as to project upward from the upper edge thereof. The grip 96*a* is formed in a U-shape opening downward as viewed from the side. The grip 96*a* is provided to have an upper side portion extending in the back and forth direction and to be inclined so as to be protrude slightly outwardly from the side wall section 94 corresponding thereto. Grips 96*b* are provided at left and right upper portions of the rear wall sections 93 so as to project upward from the upper edge thereof. The grip 96*b* is formed in a U-shape opening downward as viewed from the rearward. The grip 96*b* is provided to have a upper side portion extending in the leftward and rightward direction and to extend almost vertically so as to be located flush with the rear wall section 93.

The left side portion of the net 56 is pivotally and supportably connected to the left side portion of the frame 53 via the hinge 82 as described above. The net 56 is turned via the hinge 82 so as to lift the right side portion of the net 56 configured as above upward, bringing the bottom wall section 92 into an almost upright state. In this state, the waste collected in the net 56 drops on the left side wall section 94 and is discharged along the left side wall section 94 to the outside of the net 56.

Since the grips 96*a*, 96*b* are attached to the appropriate portions (at least a portion opposite to the hinge 82) of the surrounding section 91 of the net 56, the recovery work of the waste by turning the net 56 can be facilitated. The hinges 82 are arranged on one short side (left side) of the horizontally long net 56. Therefore, when the net 56 is raised, the length from a pivotal shaft to the operating part (the right grips) can be ensured to facilitate the turning operation of the net 56.

The left side wall section 94 (namely, the wall section close to the hinge 82 of the surrounding portion 91) of the net 56 is a wall portion to which a plate member is attached to satisfactorily discharge the waste. The upper edge portion of the left side wall section 94 of the net 56 is set to protrude leftward relative to the left side structure 41L of the waste recovery station 40 in the upright state of the bottom wall section 92 (see FIG. 18). If a waste collection container is disposed leftward adjacent to the waste recovery station 40, the waste collected in the net 56 is directly thrown into the container with the left side wall section 94 sloped. The right side wall section 94 and rear wall section 93 of the net 56 serve as net portions to which wire meshes with large meshes are attached in order to prevent the waste thrown in the net 56 from dropping.

Left front and rear end stoppers 97*a*, 97*b* are respectively provided on the left longitudinal member 51 of the frame 53 so as to position the left front and rear ends of the net 56. Similarly, right front and rear end stoppers 97*a*, 97*b* are respectively provided on the right longitudinal member 51 of the frame 53 so as to position the right front and rear ends of the net 56. Each of the stoppers 97*a*, 97*b* includes an almost vertical position-restriction surface in abutment against the front or rear end of the net 56; and a turn guide surface which is contiguous to the position restriction surface from above so as to be inclined upward. The stoppers are each detachably attached to the longitudinal member 51 using e.g. bolts or the like.

The front ends of both sides of the net 56 in the usage state (the state where the bottom wall section 92 is almost horizontally abutted against the frame 53) are abutted against the position restriction surfaces of the left and right front end stoppers 97*a*. In addition, the rear ends of both sides of the net 56 in the usage state are abutted against the position restriction surface of the left and right rear end stoppers 97*b*. Thus, the net 56 can be positioned with respect to the frame of the net 56 in the back and forth direction. When the net 56 is turned to be brought from the upright state into the usage state, the front and rear ends of both sides of the net 56 are guided by the guide surfaces of the stoppers 97*a*, 97*b* and the net 56 is smoothly returned to a predetermined position on the frame 53.

Figure 23A:
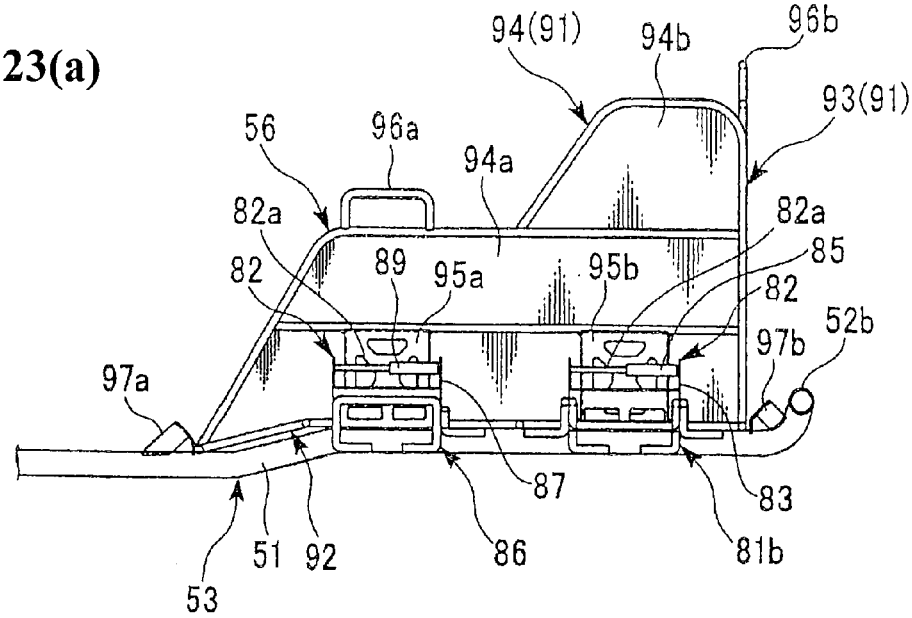
FIGS. 23(*a*) and (*b*) illustrate an example where the net of the second beach cleaner is made movable forwardly and backwardly, in which FIG. 23(*a*) is a side view of the net located at its withdrawal position, and FIG. 23(*b*) is a side view of the net located at its forward position.
Figure 23B:
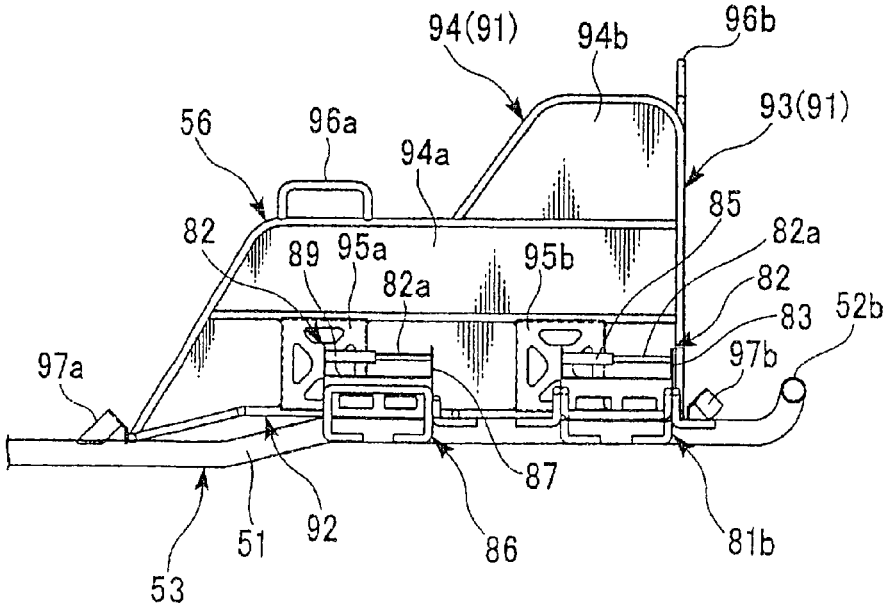

Referring to FIG. 23, the attachment positions of the stoppers 97*a*, 97*b* to the longitudinal members 51 may be made movable forwardly and backwardly. In this case, the lengths of the hinge pipes 85, 89 on the left side of the net 56 are each made shorter than the distance between the front and rear walls 84 of the front hinge bracket 87 and between the front and rear walls 88 of the rear hinge bracket 83. This makes it possible to shift the net 56 back and forth in response to the shift of the stoppers 97*a*, 97*b*. In this way, the front end position of the net 56 can be easily changeable according to the conditions of the sand area. This makes it possible to enhance the waste capture performance of the second beach cleaner 50.

Next, a description is made of a schematic procedure for cleaning a sandy beach using the beach cleaners 20, 50.

The waste recovery station 40 which has been loaded on the trailer 13 as shown in FIG. 1 and carried to a predetermined site on the sandy beach is installed thereat. In FIG. 1, the waste recovery station 40 which has been integrally assembled is loaded on the trailer 13. However, needless to say, the waste recovery station 40 may be loaded on the trailer 13, while being divided into the side structures 41 and the connecting members 42 as described above. In this case, the work for installing the waster recovery station 40, including loading and unloading it on and from the trailer 13, can be facilitated. Incidentally, in the waste recovery station 40 in FIG. 1, only the foot members 45 are removed therefrom.

The hardness of the sandy beach is next measured. The hardness is a criterion for determining the number of the sand pins 23 of the first beach cleaner 20, the amount of digging the keels 54 and scrapers 55 of the second beach cleaner 50 and the like into the sand. This measurement is performed by allowing e.g. an iron pile with a predetermined size to freely fall on a sandy beach. The hardness of the sandy beach is evaluated at three levels (soft, standard and hard) on the basis of the average of the measurements. The number of the sand pins 23, the weight of the weight 34, the attachment height of the ski legs, the positions of connecting the connecting rod 38 to the tow portions 37, 67 and the like are determined in accordance with the hardness of the sandy beach thus measured and the condition of scattered waste or the like.

Figure 24:
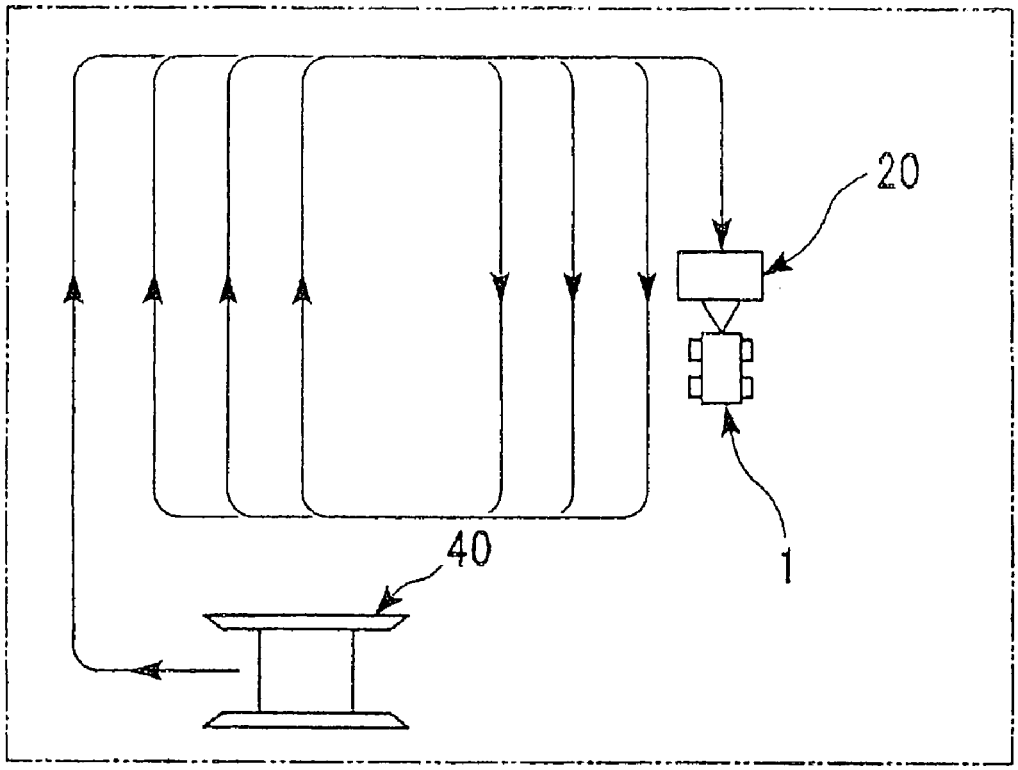
FIG. 24 is an explanatory diagram illustrating the running trajectory of a vehicle when the beach cleaners of the embodiment clean a sandy beach.

The first beach cleaner 20 is then unloaded from the trailer 13 and subjected to the settings based on the measurements of the hardness of the sandy beach. The first beach 20 is towed by the vehicle 1 to run on the sandy beach at a constant speed. In this case, as shown in FIG. 24, the running trajectory is obtained by the vehicle 1 and the first beach cleaner 20 which turn along almost-squares, shifting their turning position in the predetermined area on a sand area, thereby making it possible to sweep the predetermined area surely and evenly. The first beach cleaner 20 collects relatively large waste on the sandy beach while digging the sand pins 23 in the sand, being subjected to relatively large travel resistance. Thus, the traveling speed is set at as low as about 5 to 10 km/h.

When the first beach cleaner 20 runs on the sandy beach as described above to collect a predetermined amount of waste under the frame 22, it once returns to the waste recovery station 40, where the waste collected is recovered. In this case, the vehicle 1 passes between the left and right side structures 41 of the waste recovery station 40 and then the first beach cleaner 20 enters between the left and right side structures 41. At this time, the left and right lift arms 39 ride on the left and right side structures 41, respectively, whereby the first beach cleaner 20 is lifted up at a predetermined amount (see FIG. 13). In the state, the vehicle 1 and the first beach cleaner 20 are stopped and the waste is allowed to drop on the sand area for recovery work. Thereafter, the vehicle 1 and the first beach cleaner 20 are made to run again to repeat the waste collecting work described earlier.

After the first beach cleaner 20 cleans the predetermined area, the second beach cleaner 50 is towed to run on the same area to collect relatively small waste on the sandy beach. In this way, the second beach cleaner 50 is used after the first beach cleaner 20 is used; therefore, the keels 54, the scrapers 55, the net 56 and the like which deal with small waste can be prevented from being damaged. The running trajectory of the second beach cleaner 50 is the same as that of the first beach cleaner 20. When the second beach cleaner 50 runs on a sandy beach, the sandy beach is soft because it has been broken up by the action of the first beach cleaner 20. In addition, it is necessary for the keels 54 and the scrapers 55 to scrape out sand and waste. Thus, the traveling speed of the second beach cleaner 50 is set to about 15 to 25 km/h, which is slightly faster than that of the first beach cleaner 20.

While the second beach cleaner 50 runs on the sandy beach, the keels 54 and the scrapers 55 scrape out relatively small waste together with sand, which is collected in the net 56 at the rear portion of the frame 53. The net 56 on the bottom wall section 92 is set such that the wire meshes are smaller in mesh size in the order from the front side. Thus, the waste collected is unlikely to drop and the wire meshes can be prevented from clogging.

After the second beach cleaner 50 runs on the sandy beach to collect a predetermined amount of waste in the net 56 as described above, it once returns to the waste recovery station 40, in which the waste collected is recovered from the second beach cleaner 50. In this recovery work, when the vehicle 1 passes between the left and right side structures 41 of the waste recovery station 40 and then the second beach cleaner 50 enters between the left and right side structures 41, the front and rear, left and right lift arms 81*a*, 81*b* ride on the left and right side structures 41 to lift up the second beach cleaner 50 at a predetermined amount. In the state, the vehicle 1 and the second beach cleaner 50 are stopped and the net 56 is turned to recover the collected waste. Thereafter, the vehicle 1 and the second beach cleaner 50 are made to run again to repeat the waste collecting work described earlier.

As described above, the first beach cleaner 20 of the embodiment includes the plurality of longitudinal members 21 extending in the traveling direction spaced widthwise apart from each other, forming the floor grate-like frame 22. The longitudinal members 21 are provided with the plurality of sand pins 23 projecting downward therefrom. The frame 22 is provided at its front end with the tow portion 37. The first beach cleaner 20 is towed by the towing vehicle 1 to run on a sand area while the sand pins 23 scrape and collect waste scattered thereon. The sand pins 23 are detachably attached to the longitudinal members 21.

With this configuration, the number of the sand pins 23 can be increased or reduced. If the sand area has large resistance, the number of the sand pins 23 is reduced. If the sand area has small resistance, the number of the sand pins 23 is increased. Thus, the amount of burying the sand pins 23 in the sand area can be optimized to thereby enhance waste collection performance.

Since the first beach cleaner 20 is provided with the weight mount portion 31 on the frame 22, the amount of burying the sand pins 23 in the sand area can be also adjusted by the heft of the weight, thereby further enhancing the waste collection performance.

Figure 27:
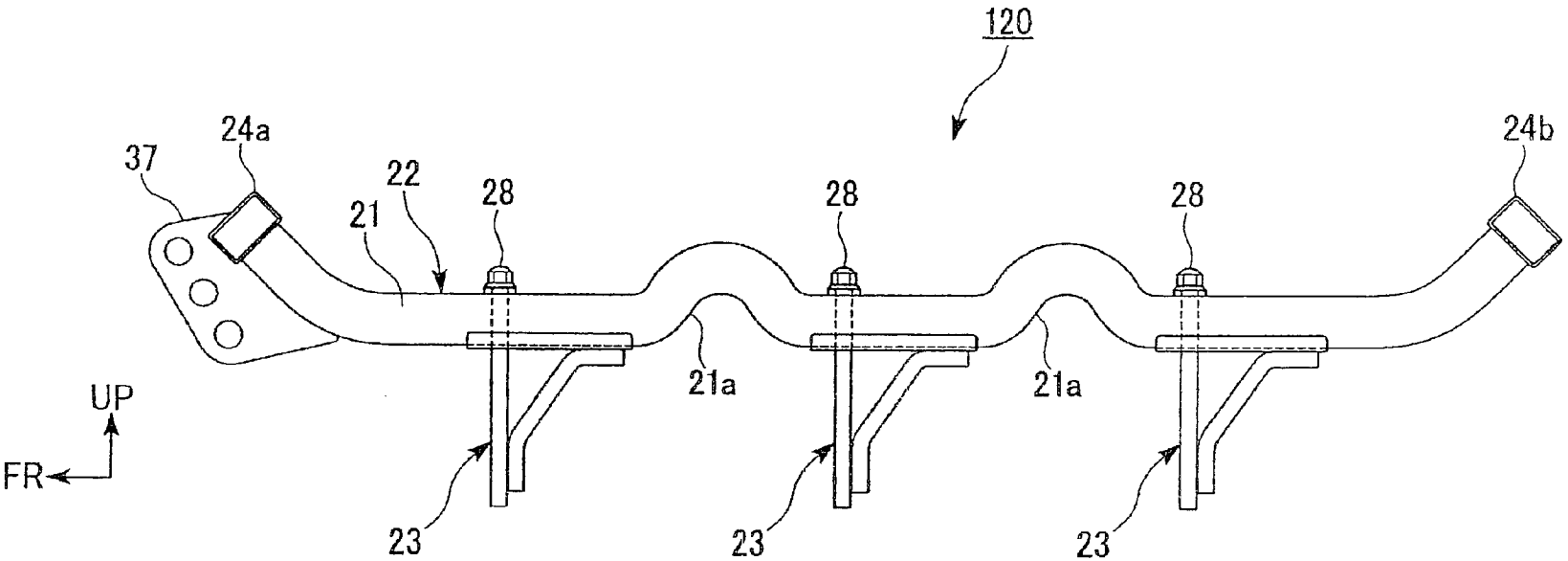
FIG. 27 is a side view of a modified example of the first beach cleaner described above.

The present invention is not limited to the embodiment described above. For example, like a first beach cleaner 120 shown in FIG. 27, waste collecting portions 21*a* may be provided at portions, of the longitudinal member 21, between the sand pins 23 aligned in the back and forth direction in the frame 22 by bending the longitudinal members 21 upward. This prevents the frame 22 from riding on the waste scraped and collected to float. Thus, the amount of sinking of the sand pins 23 in the sand is maintained at an appropriate amount, thereby satisfactorily maintaining the waste collection performance.

Figure 28:
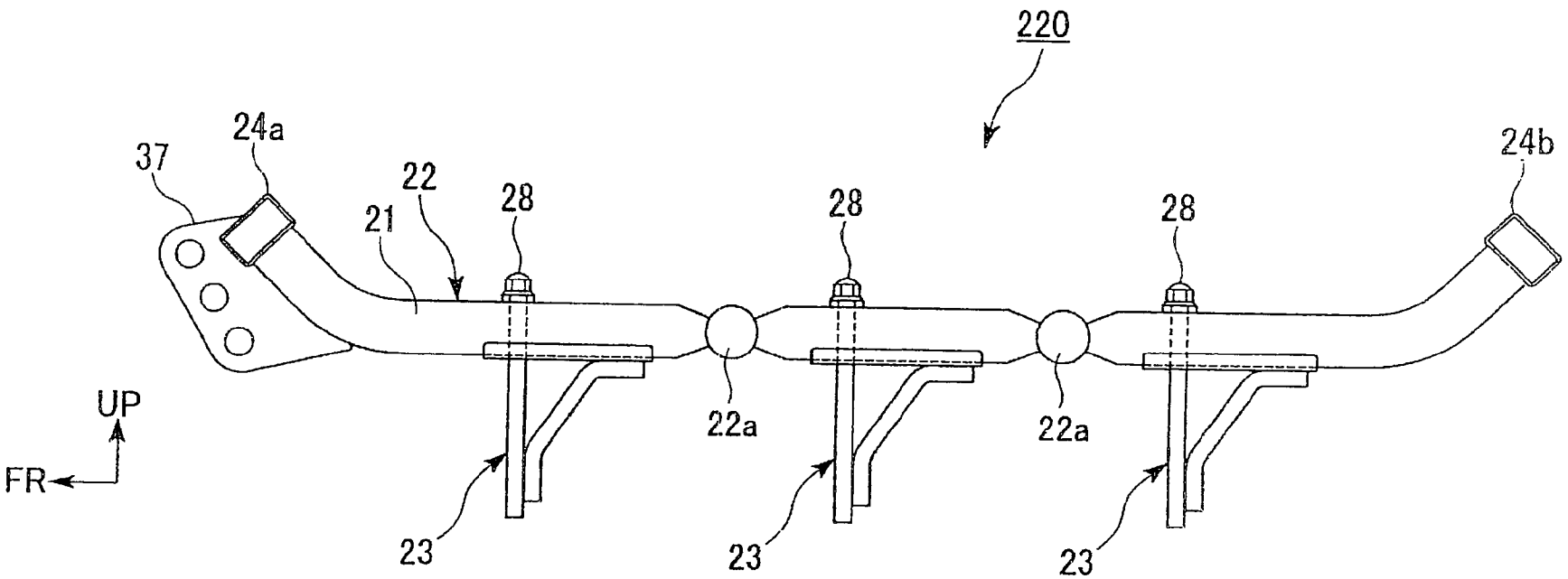
FIG. 28 is a side view of a second modified example of the first beach cleaner described above.

Alternatively, like a first beach cleaner 220 shown in FIG. 28, joint portions 22*a* bendable up and down and (or) right and left may be provided at portions, of the frame 22, between the sand pins 23 aligned in the back and forth direction in the frame 22. This prevents the frame 22 from floating due to the frame 22 riding on the waste scraped and collected or to the influence of the undulation of the sand area. Thus, the waste collection performance can be satisfactorily maintained similarly to the above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A beach cleaner, comprising:

a frame having a plurality of longitudinal members extending in a traveling direction, the longitudinal members being spaced apart widthwise with respect to each other to form a floor of a grate frame, a plurality of sand pins projecting downward in a plurality of different positions from a lower surface of each of the longitudinal members, a fastening member for fixing each of the plurality of sand pins to the longitudinal members, a weight mount portion having a C-shaped support bracket which opens toward a rear of the beach cleaner, wherein the weight mount portion is detachably mountable on at least one of the longitudinal members above any two adjacent ones of the sand pins, and is fixable to the longitudinal members by the corresponding fastening members fixing the any two adjacent sand pins to the longitudinal members, wherein when the weight mount portion is fixed to the at least one of the longitudinal members, the C-shaped support bracket is adapted to receive therein at least one block for apply a downward force to the frame, wherein the beach cleaner further comprises:

a tow portion provided at a front end of the frame, wherein when the beach cleaner is pulled by a towing vehicle and runs on a sand area, the sand pins scrape and collect scattered waste.

2. The beach cleaner according to claim 1, further comprising a waste collecting portion provided between the sand pins aligned in a back and forth direction in the frame.

3. The beach cleaner according to claim 1, further comprising a waste collecting portion provided between the sand pins aligned in a back and forth direction in the frame.

4. The beach cleaner according to claim 1, further comprising a joint portion provided between the sand pins aligned in a back and forth direction of the frame.

5. The beach cleaner according to claim 1, wherein the weight mount portion is attached to a portion of the frame with the two adjacent sand pins.

6. The beach cleaner according to claim 1, wherein the one block includes a lower block fixedly connected at a rear portion thereof by a retaining member passing up and down through the lower block and the support bracket, and an upper block fitted to the lower block from above by a another retaining member extending through only the upper and lower blocks, wherein the another retaining member which fixes the upper block to the lower block is located above the rear hole, and rearwardly with respect to the retaining member fixing the lower block to the support bracket.

7. The beach cleaner according to claim 1, further comprising waste collecting portions provided at portions of the longitudinal members between the sand pins, the waste collecting portions being upwardly curved portions of the longitudinal members, the upwardly curved portions being aligned in a back and forth direction of the frame, wherein the waste collecting portions are portions of the longitudinal members which bulge upwardly.

8. The beach cleaner according to claim 4, wherein the joint portion is a part of the frame that is bendable.

9. A beach cleaner, comprising:

a plurality of longitudinal members extending in a traveling direction, the longitudinal members being spaced apart widthwise with respect to each other to form a floor of a grate frame, each of the longitudinal members having a plurality of holes with vertical axes, a plurality of sand pins projecting downward from each of the longitudinal members, each of the sand pins being integrally formed with a substantially horizontal plate member, and a substantially vertical pin main body formed at its upper portion with an external thread portion, each of the external thread portions of the sand pins passing through a corresponding one the holes from below and projecting upwardly, the plate members of the sand pins abutting against lower surfaces of the corresponding longitudinal members, and nuts being fastened onto portions of the corresponding external thread portions projecting above the longitudinal member, whereby the plurality of sand pins is detachably attached to each of the plurality of longitudinal members, the beach cleaner further comprising:

a weight mount portion, the weight mount portion including a support bracket to which a lower block is fixedly connected at a rear portion thereof by a retaining member passing up and down through the lower block and the support bracket, and an upper block fitted to the lower block from above by another retaining member extending through only the upper and lower blocks, the upper block extending further upwardly and rearwardly than the lower block, and a tow portion provided at a front end of the frame, wherein the beach cleaner is adapted to be pulled by a towing vehicle and to run on a sand area while the sand pins scrape and collect scattered waste, each of the retaining members extends parallel to the vertical pin main body of each of the sand pins.

10. The beach cleaner according to claim 9, wherein the weight mount portion is detachably mountable in any of a plurality of alternative positions to upper surfaces of two adjacent ones of the longitudinal members, wherein the weight mount portion includes a pair of base parts supported respectively by two adjacent ones of longitudinal members, each of the base parts including a forward hole and a rear hole for receiving the external thread portions of two adjacent ones of the sand pins along a length of the corresponding longitudinal member, the weight mount portion being detachably mountable by the nuts fastened onto the external thread portions of the two adjacent sand pins on each of the two adjacent ones of longitudinal members, and wherein the another retaining member which fixes the upper block to the lower block is located rearwardly of the retaining member which fixes the lower block to the support portion.

11. The beach cleaner according to claim 9, further comprising a waste collecting portion provided between the sand pins aligned in a back and forth direction in the frame.

12. The beach cleaner according to claim 9, further comprising a joint portion provided between the sand pins aligned in a back and forth direction of the frame.

13. The beach cleaner according to claim 10, wherein the weight mount portion is attached to a portion of the frame with the sand pins.

14. The beach cleaner according to claim 9, further comprising waste collecting portions provided at portions of the longitudinal members between the sand pins, the waste collecting portions being upwardly curved portions of the longitudinal members, the upwardly curved portions being aligned in a back and forth direction of the frame.

15. The beach cleaner according to claim 12, wherein the joint portion is a part of the frame that is bendable.

16. A beach cleaner, comprising:

a plurality of longitudinal members extending in a traveling direction, the longitudinal members being spaced apart widthwise with respect to each other to form a floor of a grate frame, each of the longitudinal members having a plurality of holes with vertical axes;

a plurality of sand pins projecting downward from each of the longitudinal members, the sand pins being integrally formed with a substantially horizontal plate member, a substantially vertical pin main body formed at its upper portion with an external thread portion, and a support member bridging between a lower portion of the pin main body and a rear portion of the plate member, each of the external thread portions of the sand pins passing through a corresponding one the holes from below and projecting upwardly therefrom, the plate members of the sand pins abutting against lower surfaces of the corresponding longitudinal members, and nuts being fastened onto portions of the corresponding external thread portions projecting above the longitudinal member, whereby the plurality of sand pins is detachably attached to each of the plurality of longitudinal members;

the beach cleaner further comprising:

a weight mount portion which is detachably mountable in any of a plurality of alternative positions to upper surfaces of two adjacent ones of the longitudinal members, wherein the weight mount portion includes a pair of base parts supported respectively by two adjacent ones of longitudinal members, each of the base parts extending in the back and forth direction and are formed to have the same left-right width as that of the adjacent longitudinal members, each of the base parts including a forward hole and a rear hole capable of receiving the external thread portions of two adjacent ones of the sand pins along a length of the corresponding longitudinal member, the weight mount portion being detachably mountable by the nuts fastened onto the external thread portions of the two adjacent sand pins on the corresponding longitudinal member; and a tow portion provided at a front end of the frame, wherein when the beach cleaner is pulled by a towing vehicle and runs on a sand area, each of the sand pins scrapes and collects scattered waste.

17. The beach cleaner according to claim 16, wherein the weight mount portion includes a support bracket to which a lower block fitted to the weight mount portion from a rearward direction is fixedly connected at a rear portion thereof by a retaining member passing up and down through the lower block and the support bracket, and an upper block fitted to the lower block from above by another retaining member extending through only the upper and lower blocks, wherein when the beach cleaner is viewed in a left side elevation view, the support portion can be seen to have a C-shape which opens towards a rear of the beach cleaner.

* * * * *